US009688456B2

(12) United States Patent
Euler et al.

(10) Patent No.: US 9,688,456 B2
(45) Date of Patent: Jun. 27, 2017

(54) BRIM OF AN INSULATED CONTAINER

(71) Applicant: Berry Plastics Corporation, Evansville, IN (US)

(72) Inventors: John B Euler, Evansville, IN (US); David Dezhou Sun, Evansville, IN (US); Chris K Leser, Evansville, IN (US); Roy E Ackerman, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 14/106,358

(22) Filed: Dec. 13, 2013

(65) Prior Publication Data

US 2014/0166674 A1 Jun. 19, 2014

Related U.S. Application Data

(60) Provisional application No. 61/737,255, filed on Dec. 14, 2012.

(51) Int. Cl.

| | |
|---|---|
| ***A47J 41/00*** | (2006.01) |
| ***B65D 81/38*** | (2006.01) |
| ***B65D 77/20*** | (2006.01) |

(52) U.S. Cl.

CPC ..... *B65D 81/3867* (2013.01); *B65D 77/204* (2013.01); *B65D 81/3874* (2013.01)

(58) Field of Classification Search

CPC ..... B65D 81/3867; B65D 77/204; B65D 81/3874; B65D 1/265; B65D 1/028; A47G 19/2205

USPC ..... 220/592.17; 229/400, 403

See application file for complete search history.

(56) References Cited

U.S. PATENT DOCUMENTS

| | | | | |
|---|---|---|---|---|
| 1,396,282 | A | | 11/1921 | Penn |
| 1,435,120 | A | | 11/1922 | Holman |
| 1,920,529 | A | * | 8/1933 | Sidebotham ..... 229/5.6 |
| 1,969,030 | A | | 8/1934 | Page |
| 2,097,899 | A | | 11/1937 | Smith |
| 2,809,776 | A | | 10/1957 | Barrington |
| 3,227,784 | A | | 1/1966 | Blades |
| 3,312,383 | A | | 4/1967 | Shapiro |
| 3,327,038 | A | | 6/1967 | Fox |
| 3,344,222 | A | | 9/1967 | Shapiro |
| 3,381,880 | A | | 5/1968 | Lewallen et al. |
| 3,409,204 | A | | 11/1968 | Carle |
| 3,431,163 | A | | 3/1969 | Gilbert |

(Continued)

FOREIGN PATENT DOCUMENTS

| | | |
|---|---|---|
| BE | 898053 | 4/1984 |
| CA | 2291607 | 6/2000 |

(Continued)

OTHER PUBLICATIONS

International Search Report dated Jul. 29, 2013, relating to International Application No. PCT/US2012/043016, 25 pages.

(Continued)

*Primary Examiner* — Fenn Mathew
*Assistant Examiner* — Don M Anderson
(74) *Attorney, Agent, or Firm* — Barnes & Thornburg LLP

(57) ABSTRACT

A container is formed to include an interior region and a brim defining a mouth opening into the interior region. The container includes a floor and a side wall coupled to the floor and to the brim.

18 Claims, 11 Drawing Sheets

(56) References Cited

Figure 1:
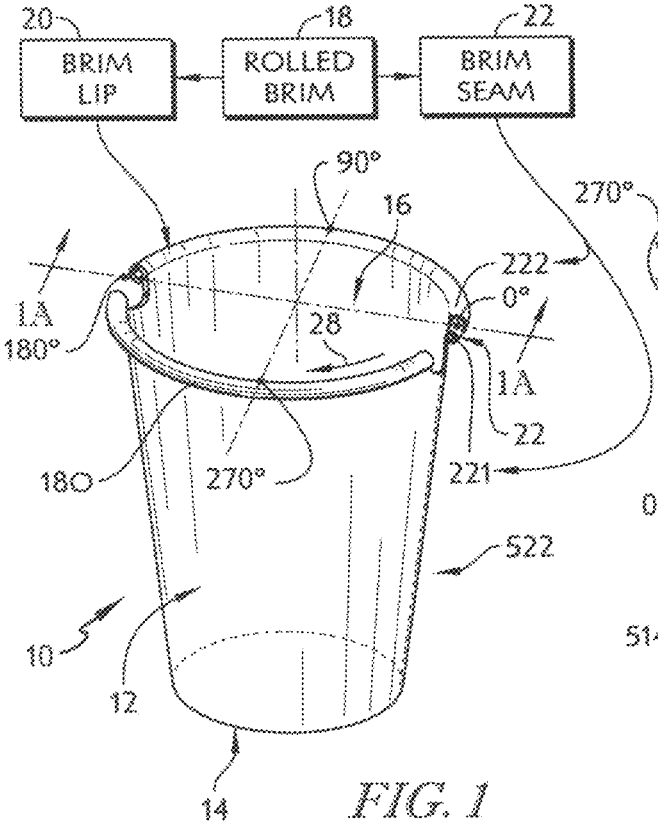

U.S. PATENT DOCUMENTS 3,468,467 A 9/1969 Amberg
3,547,012 A 12/1970 Amberg
3,583,624 A 6/1971 Peacock
3,661,282 A 5/1972 Buhayar
3,733,381 A 5/1973 Willette
3,793,283 A 2/1974 Frailey
3,846,349 A 11/1974 Harada
3,919,368 A 11/1975 Seto
RE28,658 E 12/1975 Macdaniel
3,967,991 A 7/1976 Shimano
3,971,696 A 7/1976 Manfredi
3,973,721 A 8/1976 Nakane
4,026,458 A 5/1977 Morris
4,049,122 A 9/1977 Maxwell
4,070,513 A 1/1978 Rhoads
4,106,397 A 8/1978 Amberg
4,171,085 A 10/1979 Doty
4,197,948 A 4/1980 Amberg
4,240,568 A 12/1980 Pool
4,284,226 A 8/1981 Herbst
4,298,331 A 11/1981 Mueller
4,299,349 A 11/1981 Gilden
4,300,891 A 11/1981 Bemiss
4,306,849 A 12/1981 Cress
4,349,400 A 9/1982 Gilden
4,365,460 A 12/1982 Cress
4,409,045 A 10/1983 Busse
4,550,046 A 10/1985 Miller
4,579,275 A 4/1986 Peelman
4,604,324 A 8/1986 Nahmias
4,621,763 A 11/1986 Brauner
4,706,873 A * 11/1987 Schulz ..... 229/400
4,720,023 A 1/1988 Jeff
4,878,970 A 11/1989 Schubert
4,918,112 A 4/1990 Roox
4,940,736 A 7/1990 Alteepping
5,078,817 A 1/1992 Takagaki
5,116,881 A 5/1992 Park
5,158,986 A 10/1992 Cha
5,160,674 A 11/1992 Colton
5,180,751 A 1/1993 Park
5,236,963 A 8/1993 Jacoby
5,286,428 A 2/1994 Hayashi
5,308,568 A 5/1994 Lipp
5,348,795 A 9/1994 Park
5,366,791 A 11/1994 Carr
5,385,260 A 1/1995 Gatcomb
5,443,769 A 8/1995 Karabedian
5,445,315 A 8/1995 Shelby
5,490,631 A 2/1996 Iioka
5,547,124 A 8/1996 Mueller
5,549,864 A 8/1996 Greene
5,605,936 A 2/1997 DeNicola, Jr. et al.
5,622,308 A 4/1997 Ito
5,628,453 A 5/1997 MacLaughlin
5,629,076 A 5/1997 Fukasawa
5,713,512 A 2/1998 Barrett
5,759,624 A 6/1998 Neale
5,765,710 A 6/1998 Bergerioux
5,766,709 A 6/1998 Geddes
5,769,311 A 6/1998 Morita
5,819,507 A 10/1998 Kaneko
5,840,139 A 11/1998 Geddes
5,866,053 A 2/1999 Park
5,868,309 A 2/1999 Sandstrom
5,875,826 A 3/1999 Giousos
5,895,614 A 4/1999 Rivera
5,925,450 A 7/1999 Karabedian
5,928,741 A 7/1999 Andersen
5,944,225 A 8/1999 Kawolics
5,948,839 A 9/1999 Chatterjee
6,007,437 A 12/1999 Schickert
6,010,062 A 1/2000 Shimono
6,030,476 A 2/2000 Geddes
6,034,144 A 3/2000 Shioya
6,051,174 A 4/2000 Park
6,071,580 A 6/2000 Bland
6,083,611 A 7/2000 Eichbauer
6,103,153 A 8/2000 Park et al.
6,109,518 A 8/2000 Mueller
6,129,653 A 10/2000 Fredricks
6,136,396 A 10/2000 Gilmer
6,139,665 A 10/2000 Schmelzer
6,142,331 A 11/2000 Breining
6,169,122 B1 1/2001 Blizard
6,174,930 B1 1/2001 Agarwal
6,231,942 B1 5/2001 Blizard
6,235,380 B1 5/2001 Tupil
6,257,485 B1 7/2001 Sadlier
6,258,862 B1 7/2001 Matz
6,267,837 B1 7/2001 Mitchell
6,284,810 B1 9/2001 Burnham
6,294,115 B1 9/2001 Blizard
6,306,973 B1 10/2001 Takaoka
6,308,883 B1 * 10/2001 Schmelzer et al. ..... 229/403
6,319,590 B1 11/2001 Geddes
6,328,916 B1 12/2001 Nishikawa
6,376,059 B1 4/2002 Anderson
6,378,733 B1 4/2002 Boonzaier
6,379,802 B2 4/2002 Ito
6,383,425 B1 5/2002 Wu
6,420,024 B1 7/2002 Perez
6,444,073 B1 9/2002 Reeves
6,455,150 B1 9/2002 Sheppard
6,468,451 B1 10/2002 Perez et al.
6,472,473 B1 10/2002 Ansems
RE37,932 E 12/2002 Baldwin
6,512,019 B1 1/2003 Agarwal
6,521,675 B1 2/2003 Wu
6,541,105 B1 4/2003 Park
6,562,447 B2 5/2003 Wu
6,565,934 B1 5/2003 Fredricks
6,586,532 B1 7/2003 Gauthy
6,593,005 B2 7/2003 Tau
6,593,384 B2 7/2003 Anderson
6,613,811 B1 9/2003 Pallaver
6,616,434 B1 9/2003 Burnham
6,646,019 B2 11/2003 Perez
6,649,666 B1 11/2003 Read
6,713,139 B2 3/2004 Usui
6,720,362 B1 4/2004 Park
6,749,913 B2 6/2004 Watanabe
6,779,662 B2 8/2004 Dorsey
6,811,843 B2 11/2004 DeBraal
6,814,253 B2 11/2004 Wong
6,883,677 B2 4/2005 Goeking
6,884,377 B1 4/2005 Burnham
6,884,851 B2 4/2005 Gauthy
6,908,651 B2 6/2005 Watanabe
6,926,507 B2 8/2005 Cardona
6,926,512 B2 8/2005 Wu
6,982,107 B1 1/2006 Hennen
7,070,852 B1 7/2006 Reiners
7,074,466 B2 7/2006 DeBraal
7,094,463 B2 8/2006 Haas
7,121,991 B2 10/2006 Mannlein
7,144,532 B2 12/2006 Kim
7,173,069 B2 2/2007 Swennen
7,234,629 B2 6/2007 Ho
7,281,650 B1 10/2007 Milan
7,355,089 B2 4/2008 Chang
7,361,720 B2 4/2008 Pierini
7,365,136 B2 4/2008 Huovinen
7,423,071 B2 9/2008 Mogami
7,458,504 B2 12/2008 Robertson
7,504,347 B2 3/2009 Poon
7,510,098 B2 3/2009 Hartjes
7,513,386 B2 4/2009 Hartjes
7,514,517 B2 4/2009 Hoenig
7,524,911 B2 4/2009 Karjala
7,557,147 B2 7/2009 Martinez
7,579,408 B2 8/2009 Walton
7,582,716 B2 9/2009 Liang
7,585,557 B2 9/2009 Aylward

(56) References Cited

U.S. PATENT DOCUMENTS

| | | | |
|---|---|---|---|
| 7,592,397 | B2 | 9/2009 | Markovich |
| 7,608,668 | B2 | 10/2009 | Shan |
| 7,622,179 | B2 | 11/2009 | Patel |
| 7,622,529 | B2 | 11/2009 | Walton |
| 7,629,416 | B2 | 12/2009 | Li |
| 7,655,296 | B2 | 2/2010 | Haas |
| 7,662,881 | B2 | 2/2010 | Walton |
| 7,666,918 | B2 | 2/2010 | Prieto |
| 7,671,106 | B2 | 3/2010 | Markovich |
| 7,671,131 | B2 | 3/2010 | Hughes |
| 7,673,564 | B2 | 3/2010 | Wolf |
| 7,687,442 | B2 | 3/2010 | Walton |
| 7,695,812 | B2 | 4/2010 | Peng |
| 7,714,071 | B2 | 5/2010 | Hoenig |
| 7,732,052 | B2 | 6/2010 | Chang |
| 7,737,061 | B2 | 6/2010 | Chang |
| 7,737,215 | B2 | 6/2010 | Chang |
| 7,741,397 | B2 | 6/2010 | Liang |
| 7,754,814 | B2 | 7/2010 | Barcus |
| 7,759,404 | B2 | 7/2010 | Burgun et al. |
| 7,786,216 | B2 | 8/2010 | Soediono |
| 7,795,321 | B2 | 9/2010 | Cheung |
| 7,803,728 | B2 | 9/2010 | Poon |
| 7,811,644 | B2 | 10/2010 | DeBraal |
| 7,818,866 | B2 | 10/2010 | Hollis |
| 7,820,282 | B2 | 10/2010 | Haas |
| 7,825,166 | B2 | 11/2010 | Sasaki |
| 7,841,974 | B2 | 11/2010 | Hartjes |
| 7,842,770 | B2 | 11/2010 | Liang |
| 7,858,706 | B2 | 12/2010 | Arriola |
| 7,863,379 | B2 | 1/2011 | Kapur |
| 7,883,769 | B2 | 2/2011 | Seth |
| 7,893,166 | B2 | 2/2011 | Shan |
| 7,897,689 | B2 | 3/2011 | Harris |
| 7,906,587 | B2 | 3/2011 | Poon |
| 7,910,658 | B2 | 3/2011 | Chang |
| 7,915,192 | B2 | 3/2011 | Arriola |
| 7,918,005 | B2 | 4/2011 | Hollis |
| 7,918,016 | B2 | 4/2011 | Hollis |
| 7,922,071 | B2 | 4/2011 | Robertson |
| 7,928,162 | B2 | 4/2011 | Kiss |
| 7,935,740 | B2 | 5/2011 | Dang |
| 7,947,367 | B2 | 5/2011 | Poon |
| 7,951,882 | B2 | 5/2011 | Arriola |
| 7,977,397 | B2 | 7/2011 | Cheung |
| 7,989,543 | B2 | 8/2011 | Karjala |
| 7,993,254 | B2 | 8/2011 | Robertson |
| 7,998,579 | B2 | 8/2011 | Lin |
| 7,998,728 | B2 | 8/2011 | Rhoads |
| 8,003,176 | B2 | 8/2011 | Ylitalo |
| 8,003,744 | B2 | 8/2011 | Okamoto |
| 8,012,550 | B2 | 9/2011 | Ylitalo |
| 8,026,291 | B2 | 9/2011 | Handa |
| 8,043,695 | B2 | 10/2011 | Ballard |
| 8,067,319 | B2 | 11/2011 | Poon |
| 8,076,381 | B2 | 12/2011 | Miyagawa |
| 8,076,416 | B2 | 12/2011 | Ellul |
| 8,084,537 | B2 | 12/2011 | Walton |
| 8,087,147 | B2 | 1/2012 | Hollis |
| 8,105,459 | B2 | 1/2012 | Alvarez |
| 8,119,237 | B2 | 2/2012 | Peng |
| 8,124,234 | B2 | 2/2012 | Weaver |
| 8,173,233 | B2 | 5/2012 | Rogers |
| 8,198,374 | B2 | 6/2012 | Arriola |
| 8,211,982 | B2 | 7/2012 | Harris |
| 8,227,075 | B2 | 7/2012 | Matsushita |
| 8,273,068 | B2 | 9/2012 | Chang |
| 8,273,826 | B2 | 9/2012 | Walton |
| 8,273,838 | B2 | 9/2012 | Shan |
| 8,288,470 | B2 | 10/2012 | Ansems |
| 8,304,496 | B2 | 11/2012 | Weaver |
| 8,404,780 | B2 | 3/2013 | Weaver |
| 8,435,615 | B2 | 5/2013 | Tsuchida et al. |
| 8,679,620 | B2 | 3/2014 | Matsushita |
| 8,883,280 | B2 | 11/2014 | Leser |
| 2001/0010849 | A1 | 8/2001 | Blizard |
| 2001/0041236 | A1 | 11/2001 | Usui |
| 2002/0030296 | A1 | 3/2002 | Geddes |
| 2002/0058126 | A1 | 5/2002 | Kannankeril |
| 2002/0135088 | A1 | 9/2002 | Harfmann |
| 2002/0137851 | A1 | 9/2002 | Kim |
| 2002/0144769 | A1 | 10/2002 | Debraal |
| 2002/0172818 | A1 | 11/2002 | DeBraal |
| 2003/0003251 | A1 | 1/2003 | DeBraal |
| 2003/0017284 | A1 | 1/2003 | Watanabe |
| 2003/0021921 | A1 | 1/2003 | Debraal |
| 2003/0029876 | A1 | 2/2003 | Giraud |
| 2003/0108695 | A1 | 6/2003 | Freek |
| 2003/0138515 | A1 | 7/2003 | Harfmann |
| 2003/0211310 | A1 | 11/2003 | Haas |
| 2003/0228336 | A1 | 12/2003 | Gervasio |
| 2003/0232210 | A1 | 12/2003 | Haas |
| 2004/0013830 | A1 | 1/2004 | Nonomura |
| 2004/0031714 | A1 | 2/2004 | Hanson |
| 2004/0038018 | A1 | 2/2004 | Anderson |
| 2004/0115418 | A1 | 6/2004 | Anderson |
| 2004/0170814 | A1 | 9/2004 | VanHandel |
| 2005/0003122 | A1 | 1/2005 | Debraal |
| 2005/0006449 | A1 | 1/2005 | DAmato |
| 2005/0101926 | A1 | 5/2005 | Ausen |
| 2005/0104365 | A1 | 5/2005 | Haas |
| 2005/0121457 | A1 | 6/2005 | Wilson |
| 2005/0124709 | A1 | 6/2005 | Krueger |
| 2005/0145317 | A1 | 7/2005 | Yamamoto |
| 2005/0147807 | A1 | 7/2005 | Haas |
| 2005/0159496 | A1 | 7/2005 | Bambara |
| 2005/0165165 | A1 | 7/2005 | Zwynenburg |
| 2005/0184136 | A1 | 8/2005 | Baynum, III |
| 2005/0236294 | A1 | 10/2005 | Herbert |
| 2005/0256215 | A1 | 11/2005 | Burnham |
| 2005/0272858 | A1 | 12/2005 | Pierini |
| 2005/0288383 | A1 | 12/2005 | Haas |
| 2006/0000882 | A1 | 1/2006 | Darzinskas |
| 2006/0094577 | A1 | 5/2006 | Mannlein |
| 2006/0095151 | A1 | 5/2006 | Mannlein |
| 2006/0135679 | A1 | 6/2006 | Winowiecki |
| 2006/0135699 | A1 | 6/2006 | Li |
| 2006/0148920 | A1 | 7/2006 | Musgrave |
| 2006/0151584 | A1 | 7/2006 | Wonnacott |
| 2006/0178478 | A1 | 8/2006 | Ellul |
| 2006/0198983 | A1 | 9/2006 | Patel |
| 2006/0199006 | A1 | 9/2006 | Poon |
| 2006/0199030 | A1 | 9/2006 | Liang |
| 2006/0199744 | A1 | 9/2006 | Walton |
| 2006/0199872 | A1 | 9/2006 | Prieto |
| 2006/0199884 | A1 | 9/2006 | Hoenig |
| 2006/0199887 | A1 | 9/2006 | Liang |
| 2006/0199896 | A1 | 9/2006 | Walton |
| 2006/0199897 | A1 | 9/2006 | Karjala |
| 2006/0199905 | A1 | 9/2006 | Hughes |
| 2006/0199906 | A1 | 9/2006 | Walton |
| 2006/0199907 | A1 | 9/2006 | Chang |
| 2006/0199908 | A1 | 9/2006 | Cheung |
| 2006/0199910 | A1 | 9/2006 | Walton |
| 2006/0199911 | A1 | 9/2006 | Markovich |
| 2006/0199912 | A1 | 9/2006 | Fuchs |
| 2006/0199914 | A1 | 9/2006 | Harris |
| 2006/0199930 | A1 | 9/2006 | Shan |
| 2006/0199931 | A1 | 9/2006 | Poon |
| 2006/0199933 | A1 | 9/2006 | Okamoto |
| 2006/0205833 | A1 | 9/2006 | Martinez |
| 2006/0211819 | A1 | 9/2006 | Hoenig |
| 2006/0234033 | A1 | 10/2006 | Nishikawa |
| 2006/0289609 | A1 | 12/2006 | Fritz |
| 2006/0289610 | A1 | 12/2006 | Kling |
| 2007/0000983 | A1 | 1/2007 | Spurrell |
| 2007/0010616 | A1 | 1/2007 | Kapur |
| 2007/0032600 | A1 | 2/2007 | Mogami |
| 2007/0056964 | A1 | 3/2007 | Holcomb |
| 2007/0065615 | A1 | 3/2007 | Odle |
| 2007/0066756 | A1 | 3/2007 | Poon |
| 2007/0078222 | A1 | 4/2007 | Chang |
| 2007/0095837 | A1 | 5/2007 | Meier |
| 2007/0112127 | A1 | 5/2007 | Soediono |

(56) References Cited

U.S. PATENT DOCUMENTS

| | | | | |
|---|---|---|---|---|
| 2007/0141188 | A1 | 6/2007 | Kim | |
| 2007/0155900 | A1 | 7/2007 | Chang | |
| 2007/0167315 | A1 | 7/2007 | Arriola | |
| 2007/0167575 | A1 | 7/2007 | Weaver | |
| 2007/0167578 | A1 | 7/2007 | Arriola | |
| 2007/0202330 | A1 | 8/2007 | Peng | |
| 2007/0219334 | A1 | 9/2007 | Shan | |
| 2008/0020162 | A1 | 1/2008 | Fackler | |
| 2008/0045638 | A1 | 2/2008 | Chapman | |
| 2008/0118738 | A1 | 5/2008 | Boyer | |
| 2008/0121681 | A1 | 5/2008 | Wiedmeyer | |
| 2008/0138593 | A1 | 6/2008 | Martinez | |
| 2008/0156857 | A1* | 7/2008 | Johnston | 229/100 |
| 2008/0177242 | A1 | 7/2008 | Chang | |
| 2008/0227877 | A1 | 9/2008 | Stadlbauer | |
| 2008/0234435 | A1 | 9/2008 | Chang | |
| 2008/0260996 | A1 | 10/2008 | Heilman | |
| 2008/0269388 | A1 | 10/2008 | Markovich | |
| 2008/0280517 | A1 | 11/2008 | Chang | |
| 2008/0281037 | A1 | 11/2008 | Karjala | |
| 2008/0311812 | A1 | 12/2008 | Arriola | |
| 2009/0042472 | A1 | 2/2009 | Poon | |
| 2009/0068402 | A1 | 3/2009 | Yoshida | |
| 2009/0069523 | A1 | 3/2009 | Itakura | |
| 2009/0076216 | A1 | 3/2009 | Kiss | |
| 2009/0096130 | A1 | 4/2009 | Jones | |
| 2009/0105417 | A1 | 4/2009 | Walton | |
| 2009/0110855 | A1 | 4/2009 | McCarthy | |
| 2009/0110944 | A1 | 4/2009 | Aguirre | |
| 2009/0170679 | A1 | 7/2009 | Hartjes | |
| 2009/0220711 | A1 | 9/2009 | Chang | |
| 2009/0247033 | A1 | 10/2009 | Peng | |
| 2009/0263645 | A1 | 10/2009 | Barger | |
| 2009/0275690 | A1 | 11/2009 | Weaver | |
| 2009/0324914 | A1 | 12/2009 | Lieng | |
| 2010/0025073 | A1 | 2/2010 | Fagrell | |
| 2010/0028568 | A1 | 2/2010 | Weaver | |
| 2010/0029827 | A1 | 2/2010 | Ansems | |
| 2010/0040818 | A1 | 2/2010 | Farha | |
| 2010/0055358 | A1 | 3/2010 | Weaver | |
| 2010/0069574 | A1 | 3/2010 | Shan | |
| 2010/0093942 | A1 | 4/2010 | Silvis | |
| 2010/0137118 | A1* | 6/2010 | Chang | 493/114 |
| 2010/0168267 | A1 | 7/2010 | Dang | |
| 2010/0181328 | A1 | 7/2010 | Cook | |
| 2010/0181370 | A1 | 7/2010 | Berbert | |
| 2010/0196610 | A1 | 8/2010 | Chang | |
| 2010/0240818 | A1 | 9/2010 | Walton | |
| 2010/0279571 | A1 | 11/2010 | Poon | |
| 2010/0324202 | A1 | 12/2010 | Bafna | |
| 2011/0003929 | A1 | 1/2011 | Soediono | |
| 2011/0008570 | A1 | 1/2011 | Seth | |
| 2011/0009513 | A1 | 1/2011 | Chaudhary | |
| 2011/0014835 | A1 | 1/2011 | Sieradzki | |
| 2011/0091688 | A1 | 4/2011 | Maurer | |
| 2011/0104414 | A1 | 5/2011 | Onodera | |
| 2011/0111150 | A1 | 5/2011 | Matsuzaki | |
| 2011/0118370 | A1 | 5/2011 | Jiang | |
| 2011/0118416 | A1 | 5/2011 | Arriola | |
| 2011/0124818 | A1 | 5/2011 | Arriola | |
| 2011/0136959 | A1 | 6/2011 | Brandstetter | |
| 2011/0144240 | A1 | 6/2011 | Harris | |
| 2011/0217492 | A1 | 9/2011 | Stamatiou | |
| 2011/0229693 | A1 | 9/2011 | Maurer | |
| 2011/0230108 | A1 | 9/2011 | Arriola | |
| 2011/0318560 | A1 | 12/2011 | Yun | |
| 2012/0004087 | A1 | 1/2012 | Tharayil | |
| 2012/0024873 | A1 | 2/2012 | Roseblade | |
| 2012/0028065 | A1 | 2/2012 | Bafna | |
| 2012/0041148 | A1 | 2/2012 | Bafna | |
| 2012/0043374 | A1 | 2/2012 | Lemon | |
| 2012/0045603 | A1 | 2/2012 | Zerafati | |
| 2012/0108714 | A1 | 5/2012 | Wittner | |
| 2012/0108743 | A1 | 5/2012 | Krishnaswamy | |
| 2012/0125926 | A1 | 5/2012 | Iyori | |
| 2012/0132699 | A1 | 5/2012 | Mann | |
| 2012/0178896 | A1 | 7/2012 | Bastioli | |
| 2012/0184657 | A1 | 7/2012 | Lake | |
| 2012/0193365 | A1 | 8/2012 | Humphries | |
| 2012/0199278 | A1 | 8/2012 | Lee | |
| 2012/0199279 | A1 | 8/2012 | Lee | |
| 2012/0199641 | A1 | 8/2012 | Hsieh | |
| 2012/0214890 | A1 | 8/2012 | Senda | |
| 2012/0220730 | A1 | 8/2012 | Li et al. | |
| 2012/0225961 | A1 | 9/2012 | VanHorn | |
| 2012/0237734 | A1 | 9/2012 | Maurer | |
| 2012/0267368 | A1 | 10/2012 | Wu | |
| 2012/0270039 | A1 | 10/2012 | Tynys et al. | |
| 2012/0295994 | A1 | 11/2012 | Bernreitner et al. | |
| 2012/0318805 | A1* | 12/2012 | Leser et al. | 220/592.17 |
| 2012/0318807 | A1 | 12/2012 | Leser | |
| 2012/0318859 | A1 | 12/2012 | Leser | |
| 2013/0023598 | A1 | 1/2013 | Song et al. | |
| 2013/0032963 | A1 | 2/2013 | Tokiwa et al. | |
| 2013/0052385 | A1 | 2/2013 | Leser | |
| 2013/0140320 | A1 | 6/2013 | Nadella | |
| 2013/0216744 | A1 | 8/2013 | Liao | |
| 2013/0280517 | A1 | 10/2013 | Buehring et al. | |
| 2013/0303645 | A1 | 11/2013 | Dix | |
| 2014/0131430 | A1 | 5/2014 | Leser | |
| 2015/0250342 | A1 | 9/2015 | Euler | |
| 2015/0258771 | A1 | 9/2015 | Leser | |

FOREIGN PATENT DOCUMENTS

| | | | |
|---|---|---|---|
| CA | 2765489 | | 12/2010 |
| CN | 1288427 | | 3/2001 |
| CN | 1495100 | | 5/2004 |
| CN | 1942370 | | 4/2007 |
| CN | 101370873 | | 2/2009 |
| CN | 101429309 | | 5/2009 |
| CN | 101531260 | | 9/2009 |
| CN | 101538387 | | 9/2009 |
| CN | 102089370 | | 6/2011 |
| CN | 102115561 | | 7/2011 |
| CN | 102245368 | | 11/2011 |
| CN | 102391570 | | 3/2012 |
| CN | 102762350 | | 10/2012 |
| DE | 2831240 | | 1/1980 |
| DE | 2831240 | C | 3/1988 |
| DE | 102006025612 | | 11/2007 |
| DE | 102006025612 | A1 | 11/2007 |
| EP | 0001791 | | 5/1979 |
| EP | 0086869 | | 8/1983 |
| EP | 0161597 | | 11/1985 |
| EP | 0318167 | | 5/1989 |
| EP | 0520028 | | 12/1992 |
| EP | 0570221 | | 11/1993 |
| EP | 0588321 | | 3/1994 |
| EP | 0659647 | | 6/1995 |
| EP | 0879844 | | 11/1998 |
| EP | 0972727 | | 1/2000 |
| EP | 0796199 | | 2/2001 |
| EP | 0940240 | | 10/2002 |
| EP | 1308263 | | 5/2003 |
| EP | 1323779 | | 7/2003 |
| EP | 1479716 | | 11/2004 |
| EP | 1666530 | | 6/2006 |
| EP | 1754744 | | 2/2007 |
| EP | 1921023 | A1 | 5/2008 |
| EP | 1939099 | | 7/2008 |
| EP | 2266894 | | 12/2010 |
| EP | 2386584 | A1 | 11/2011 |
| EP | 2386601 | | 11/2011 |
| EP | 2720954 | | 4/2014 |
| GB | 1078326 | | 8/1967 |
| GB | 2485077 | | 5/2012 |
| JP | 52123043 | | 10/1977 |
| JP | 52123043 | U | 10/1977 |
| JP | 58029618 | | 2/1983 |
| JP | 0615751 | | 1/1994 |
| JP | 3140847 | | 1/1994 |
| JP | 06192460 | | 7/1994 |
| JP | 310847 | | 12/2000 |

(56) References Cited

FOREIGN PATENT DOCUMENTS

| | | | |
|---|---|---|---|
| JP | 2001310429 | | 11/2001 |
| JP | 2003292663 | | 10/2003 |
| JP | 2004018101 | | 1/2004 |
| JP | 2004168421 | | 6/2004 |
| JP | 2004168421 | A | 6/2004 |
| JP | 2006096390 | | 4/2006 |
| JP | 2006130814 | A | 5/2006 |
| JP | 2007154172 | | 6/2007 |
| JP | 2008162700 | | 7/2008 |
| JP | 2009504858 | | 2/2009 |
| JP | 2009066856 | A | 4/2009 |
| JP | 2009138029 | | 6/2009 |
| JP | 2009190756 | A | 8/2009 |
| KR | 100306320 | | 10/2001 |
| KR | 2003036558 | | 5/2003 |
| KR | 2004017234 | | 2/2004 |
| KR | 101196666 | | 11/2012 |
| WO | 9113933 | | 9/1991 |
| WO | 9413460 | | 6/1994 |
| WO | 9729150 | | 8/1997 |
| WO | 9816575 | | 4/1998 |
| WO | 0002800 | | 1/2000 |
| WO | 0119733 | | 3/2001 |
| WO | 0132758 | | 5/2001 |
| WO | 0153079 | | 7/2001 |
| WO | 0234824 | | 5/2002 |
| WO | 03076497 | | 9/2003 |
| WO | 03099913 | | 12/2003 |
| WO | 2004104075 | | 12/2004 |
| WO | 2006042908 | | 4/2006 |
| WO | 2006124369 | | 11/2006 |
| WO | 2007003523 | | 1/2007 |
| WO | 2007020074 | | 2/2007 |
| WO | 2007068766 | | 6/2007 |
| WO | 2007090845 | A2 | 8/2007 |
| WO | 2008030953 | | 3/2008 |
| WO | 2008038750 | | 4/2008 |
| WO | 2008045944 | | 4/2008 |
| WO | 2008057878 | | 5/2008 |
| WO | 2008080111 | | 7/2008 |
| WO | 2009035580 | | 3/2009 |
| WO | 2010006272 | | 1/2010 |
| WO | 2010019146 | | 2/2010 |
| WO | 2010076701 | A1 | 7/2010 |
| WO | 2010111869 | | 10/2010 |
| WO | 2011005856 | | 1/2011 |
| WO | 2011036272 | | 3/2011 |
| WO | 2011036272 | A2 | 3/2011 |
| WO | 2011038081 | | 3/2011 |
| WO | 2011076637 | | 6/2011 |
| WO | 2011141044 | | 11/2011 |
| WO | 2011144705 | | 11/2011 |
| WO | 2012020106 | | 2/2012 |
| WO | 2012025584 | | 3/2012 |
| WO | 2012044730 | | 4/2012 |
| WO | 2012055797 | | 5/2012 |
| WO | 2012099682 | | 7/2012 |
| WO | 2012173873 | | 12/2012 |
| WO | 2012174422 | | 12/2012 |
| WO | 2012174567 | | 12/2012 |
| WO | 2012174568 | | 12/2012 |
| WO | 2013032552 | | 3/2013 |
| WO | 2013101301 | | 7/2013 |

OTHER PUBLICATIONS

International Search Report and Written Opinion dated Sep. 17, 2013, relating to International Application No. PCT/US2012/041395.
International Search Report dated Feb. 26, 2013, relating to International Application No. PCT/US2012/043018.
International Search Report dated Jan. 29, 2013, relating to International Application No. PCT/US2012/043017.
International Search Report dated Jan. 30, 2013, relating to International Application No. PCT/US2012/042737.
International Search Report dated Jul. 30, 2012, relating to International Application No. PCT/US2012/041397.
International Search Report dated Nov. 19, 2012, relating to International Application No. PCT/US2012/041395.
Jaakko I. Raukola, A New Technology to Manufacture Polypropylene Foam Sheet and Biaxially Oriented Foam Film, VTT Publications 361, Technical Research Centre of Finland, Apr. 1998, 100 pages.
Borealis AG, Daploy(TM) HMS Polypropylene for Foam Extrusion, 2010, 20 pages.
Machine English translation of JP 2006-130814.
International Search Report and Written Opinion dated Jul. 3, 2014, relating to International Application No. PCT/US2014/025697.
International Search Report and Written Opinion dated Apr. 16, 2014, relating to International Application No. PCT/US2013/075013.
International Search Report and Written Opinion dated Apr. 21, 2014, relating to International Application No. PCT/US2013/074923.
International Search Report and Written Opinion dated Apr. 22, 2014, relating to PCT/US2013/074965.
International Search Report and Written Opinion dated Apr. 25, 2014, relating to PCT/US2013/075052.
International Search Report dated Mar. 11, 2014, relating to International Application No. PCT/US2013/66811.
European Search Report of Application No. 12861450.0, dated Nov. 21, 2014.
International Search Report dated Nov. 7, 2014, relating to International Application No. PCT/US2014/51508.
New Zealand First Examination Report for Application No. 621219 dated Nov. 17, 2014.
Third-Party Submission Under 37 CFR 1.290 filed on Dec. 9, 2014 in U.S. Appl. No. 14/063,252.
International Search Report and Written Opinion dated Jan. 19, 2015, relating to International Application No. PCT/US2014/059312.
International Search Report dated Jan. 19, 2015, relating to International Application No. PCT/US2014/059216.
Office Action dated Feb. 2, 2015 for U.S. Appl. No. 14/106,114.
Office Action dated Jan. 6, 2015 for Chinese Application No. 201280034350.9 (11 pages).
Office Action dated Jan. 9, 2015 for Chinese Application No. 201280035667.4 (22 pages).
Spanish Search Report of Application No. 201390099, dated Feb. 9, 2015.
Office action dated Apr. 11, 2014 for U.S. Appl. No. 13/526,417.
Office Action dated Aug. 19, 2014 for Chinese Application No. 201280035667.4.
Office Action dated Aug. 21, 2014 for U.S. Appl. No. 13/526,454.
Office Action dated Jul. 25, 2014 for U.S. Appl. No. 13/525,640.
Office Action dated Sep. 25, 2014 for U.S. Appl. No. 13/526,417.
Office Action dated Oct. 16, 2014 for U.S. Appl. No. 14/106,212.
New Zealand First Examination Report for Application No. 619616 dated Oct. 10, 2014.
Australian First Patent Examination Report for Application No. 2012302251 dated Jul. 9, 2015.
Office Action dated Apr. 30, 2015 for U.S. Appl. No. 14/462,073.
Office Action dated Apr. 14, 2015 for U.S. Appl. No. 14/106,212.
English translation of Spanish Search Report of Application No. 201490025, dated Apr. 20, 2015.
Spanish Search Report for Application No. 201490025, dated Apr. 20, 2015.
Machine English translation of EP0086869.
Singapore Office Action dated Dec. 18, 2014 for Singapore Application No. 2014002273.
Third-Party Submission Under 37 CFR 1.290 filed on Feb. 26, 2015 in U.S. Appl. No. 13/491,007.
Certified English translation of EP0086869.
Office Action dated Jun. 23, 2015 for U.S. Appl. No. 13/525,640.
Third Party Submission Under 37 CFR 1.290 in U.S. Appl. No. 14/188,504 submitted May 11, 2015 and May 27, 2015 (43 pages).

(56) References Cited

OTHER PUBLICATIONS

Naguib et al., "Fundamental Foaming Mechanisms Governing the Volume Expansion of Extruded Polypropylene Foams," Journal of Applied Polymer Science, vol. 91, pp. 2661-2668, 2004 (10 pages).
Wang et al., "Extending PP\s Foamability Through Tailored Melt Strength and Crystallization Kinetics," paper 19 from the Conference Proceedings of the 8th International Conferences of Blowing Agents and Foaming Processes, May 16-17, 2006 in Munich, Germany Smithers Rapra Ltd, 2006 (14 pages).
Office Action dated Oct. 8, 2015 for U.S. Appl. No. 14/188,504.
Second Chinese Office Action dated Sep. 6, 2015 for Chinese Application Serial No. 201280034350.9.
Office Action dated Oct. 27, 2015 for U.S. Appl. No. 14/462,073.
Third Party Observations filed with respect to European Patent Application No. 12727994.1, Aug. 17, 2015 (22 pages).
U.S. Appl. No. 61/498,455 filed Jun. 17, 2011, related to PCT Application No. PCT/US2012/041395, 46 pages.
"Slip Agents", Polypropylene Handbook, 2nd edition, 2005, pp. 285-286.
English translation of Russian Office Action for Application Serial No. 2015127677, dated Sep. 16, 2015.
Office Action dated Dec. 31, 2015 for U.S. Appl. No. 14/755,546.
Notice of Allowance dated Jan. 29, 2016 for U.S. Appl. No. 14/755,546.
English translation of First Office Action for Taiwanese Application No. 101121656, Nov. 13, 2015.
Singapore Notice of Eligibility for Grant, Search Report, and Examination Report transmitted Dec. 10, 2015 for Singapore Application No. 11201503336V.
Office Action dated Jan. 11, 2016 for U.S. Appl. No. 14/161,328.
International Search Report and Written Opinion dated Oct. 18, 2013, relating to International Application No. PCT/US2013/053935.
International Preliminary Report on Patentability dated Feb. 16, 2016, relating to International Application No. PCT/US2014/051508.
English Summary of Chinese Office Action for Application Serial No. 201380041896.1, dated Mar. 21, 7 pages.
Extended European Search Report for European Application No. 13827981.5-1708 / 2888092 PCT/US2013/053935, dated Feb. 19, 2016.
Australian First Patent Examination Report for Application No. 2012271047, dated Feb. 29, 2016.
N.N. Najib, N.M. Manan, A.A. Bakar, and C.S. Sipaut, Effect of Blowing Agent Concentration on Cell Morphology and Impact Properties of Natural Rubber Foam, Journal of Physical Science, vol. 20(1), 13-25, 2009 (13 pages).
Nigel Mills, Polymer Foams Handbook, Fig. 2.2, 1st ed. 2007 (2 pages).
University of Massachusetts , Advanced Plastics Processing Lecture, Lecture 11: Foam Processes, Slide 4 (Nov. 11, 2012) (2 pages).
Australian Second Patent Examination Report for Application No. 2012302251, dated Feb. 26, 2016.
English summary of Chinese Office Action for Chinese Application Serial No. 201380065781.6, Apr. 19, 2016, 14 pages.
Affidavit of Christopher Butler of Internet Archive, Borealis webpage dated Jan. 20, 2010 (https://web.archive.org/web/20100120102738/http://www.borealisgroup.com/industry-solutions/advancedpackaging/rigid-packaging/polyolefin-foam/daploy-hmspp-extruded-foam/).
Reichelt et al., "PP-Blends with Tailored Foamability and Mechanical Properties", Cellular Polymers, vol. 22, No. 5, 2003, 14 pages.
Ratzsch et al., "Radical reactions on polypropylene in the solid state", Prog. Polym. Sci. 27 (2002) 1195-1282, 88 pages.
Excerpts from Encyclopedia of Polymer Science and Technology: Plastics, Resins, Rubbers, and Fibers, "Blowing Agents", vol. 2, John Wiley & Sons, Inc. (1965), 37 pages.
Excerpts from Polymer Foams: Science and Technology, Lee et al., "Introduction to Polymeric Foams", CRC Press (2007) 51 pages.
"Daploy(TM) HMS Polypropylene for Foam Extrusion", obtained from Borealis webpage obtained from the Internet Archive\s "Wayback Machine" as of Nov. 16, 2008 https://web.archive.org/web/20081116085125/http://www.borealisgroup.com/pdf/literature/borealisborouge/brochure/K_IN0020_GB_FF_2007_10_BB.pdf).
Excerpts from Gibson and Ashby, Cellular solids: Structure and properties—Second edition, Cambridge University Press, 1997, 66 pages.
Excerpts from Maier and Calafut, Polypropylene: the Definitive User's Guild and Databook, Plastics Design Library, William Andrew Inc. (1998), 35 pages.
ASTM D3763-86, an American Society for Testing of Materials (ASTM), "Standard Method for High-Speed Puncture Properties of Plastics Using Load and Displacement Sensors" (1986 Edition), 5 pages.
ASTM D1922-93, an American Society for Testing of Materials (ASTM), "Standard Method for Propagation Tear Resistance of Plastic Film and Thin Sheeting by Pendulum Method" (1993 Edition), 5 pages.
Naguib et al., "Effect of Supercritical Gas on Crystallization of Linear and Branched Polypropylene Resins with Foaming Additives", Ind. Eng. Chem. Res., 44 (2005), 6685-6691.
Tabatabaei et al., "Rheological and thermal properties of blends of a long-chain branched polypropylene and different linear polypropylenes", Chemical Engineering Science, 64 (2009), 4719-4731.
Almanza et al., "Applicability of the Transient Plane Source Method to Measure the Thermal Conductivity of Low-Density Polyethylene Foams", Journal of Polymer Science: Part B: Polymer Physics, vol. 42 (2004), 1226-1234.
The Burn Foundation, "Scald Burns", available at https://web.archive.org/web/20080926114057/http:/wwwvii.burnfoundation.org/programs/resource.cfm?c=1&a=3, dated Sep. 26, 2008, accessed on Feb. 5, 2016.
AntiScald Inc. available at https://web.archive.org/web/20080517041952/http:/www.antiscald.com/prevention/general_info/table.php, dated May 17, 2008, accessed on Feb. 5, 2016.
"Fire Dynamics", available at http://www.nist.gov/fire/fire_behavior.cfm, accessed on Feb. 5, 2016.
"Power of a Microwave Oven", available at https://web.archive.org/web/20071010183358/http://hypertextbook.com/facts/2007/TatyanaNektalova.shtml, dated Oct. 10, 2007, accessed on Feb. 5, 2016.
Health Physics Society, "Microwave Oven Q & A", available at https://web.archive.org/web/20090302090144/http://www.hps.org/publicinformation/ate/faqs/microwaveovenq&a.html, dated Mar. 2, 2009, accessed on Feb. 5, 2016.
Cook's Info, "Microwave Ovens", available at http://www.cooksinfo.com/microwave-ovens, accessed on Feb. 5, 2016.
Antunes et al., "Heat Transfer in Polypropylene-Based Foams ProducedUsing Different Foaming Processes", Advanced Engineering Materials, 11, No. 10 (2009), 811-817.
Excerpts from Frank Kreith, Principles of Heat Transfer, 3rd ed., Intext Educational Publishers (1973).
Excerpts from James M. Gere, Mechanics of Materials, 5th ed., Brooks/Cole (2001).
Technical data sheet of HIFAX CA 60 A, obtained from https://www.lyondellbasell.com/en/polymers/p/Hifax-CA-60-A/d372c484-8f5a-4b2c-8674-8b7b781a1796, accessed on Feb. 4, 2016, 2 pages.
Michel Biron, "Chapter 4—Detailed Accounts of Thermoplastic Resins," Thermoplastics and Thermoplastic Composites, Technical Information for Plastics Users, Elsevier Ltd. (2007), 217-714.
Excerpts from Cornelia Vasile, "Mechanical Properties and Parameters of Polyolefins", Handbook of Polyolefins, 2nd ed., Marcel Dekker, Inc. (2000).
Williams et al., "Thermal Connectivity of Plastic Foams", Polymer Engineering and Science, Apr. 1983, vol. 23, No. 6., 293-298.
Excerpts from M.C. McCrum et al., Principles of Polymer Engineering, 2nd ed., Oxford Science Publications (1997).
Excerpts from Robert H. Perry, Perry\s Chemical Engineers Handbook, 7th ed., The McGraw-Hill Companies, Inc. (1997).

(56) References Cited

OTHER PUBLICATIONS

Martinez-Diez et al., "The Thermal Conductivity of a Polyethylene Foam Block Produced by a Compression Molding Process", Journal of Cellular Plastics, vol. 37 (2001), 21-42.
Borealis Product Brochure, Daploy HMS Polypropylene for Foam Extrusion (2010), 20 pages.
R. Coquard and D. Baillis, Journal of Heat Transfer, 2006, 128(6): 538-549.
A. R. Katritzky et al., "Correlation and Prediction of the Refractive Indices of Polymers by QSPR," J. Chem. Inf. Comput. Sci., 38 (1998), 1171-1176.
M. Antunes et al., "Heat Transfer in Polyolefin Foams," Heat Transfer in Multi-Phase Materials, A. Öchsner and G. E. Murch, Eds. Springer-Verlag Berlin Heidelberg, 2011, 131-161.
Inter Partes Review Petition for U.S. Pat. No. 8,883,280 (2101 pages) [Submitted in multiple parts—section 1].
Inter Partes Review Petition for U.S. Pat. No. 8,883,280 (2101 pages) [Submitted in multiple parts—section 2].
Inter Partes Review Petition for U.S. Pat. No. 8,883,280 (2101 pages) [Submitted in multiple parts—section 3].
Inter Partes Review Petition for U.S. Pat. No. 8,883,280 (2101 pages) [Submitted in multiple parts—section 4].
English summary of Mexican Office Action for Application Serial No. MX/a/2013/014993, Apr. 27, 2016, 5 pages.
Japanese Office Action for Japanese Patent Application No. 2014-528384, dated Mar. 1, 2016.
English Summary of Chinese Office Action for Application Serial No. 201380041896.1, dated Mar. 18, 2016, 7 pages.
Doerpinghaus et al., "Separating the effects of sparse long-chain branching on rheology from those due to molecular weight in polyethylenes", Journal of Rheology, 47, 717 (2003).
English Summary of Chinese Office Action for Application Serial No. 201280051426.9, Apr. 29, 2016, 5 pages.
English translation of Japanese Office Action for Japanese Application No. 2014-516089, dated May 10, 2016.
Third Party Submission Under 37 CFR 1.290 filed on May 12, 2016 in U.S. Appl. No. 14/739,510.
Daploy HMS Polypropylene for Foam Extrusion, 20 pages, Borealis Borouge Shaping the Future with Plastics, Published 2010, www.borealisgroup.com, www.borouge.com, Vienna, Austria.
Lugao, A.B. et al., HMSPP—New Developments, Chemical and Environmental Technology Center, IPEN—Progress Report, 2002-2004 (1 page).
Davesh Tripathi, Practical Guide to Polypropylene, 2002 (5 pages).
Jinghua Tian et al., The Preparation and Rheology Characterization of Long Chain Branching Polypropylene, Polymer, 2006 (9 pages).
Bc. Lukas Kovar, High Pressure Crystallization of Long Chain Branched Polypropylene, Master Thesis, Thomas Bata University in Zlin, 2010 (83 pages).
Office Action dated Jun. 30, 2016 for U.S. Appl. No. 14/106,276.
Australian First Patent Examination Report for Application No. 2012363114, dated Jun. 15, 2016, 4 pages.
Office Action for Chinese Patent Application No. 201380064860.5, dated Jun. 2, 2016 including English language summary, 13 pages.
Singapore Office Action and Written Opinion dated May 26, 2016 for Singapore Application No. 11201504333Y.
Singapore Office Action and Written Opinion dated May 27, 2016 for Singapore Application No. 11201504330U.
Singapore Office Action and Written Opinion dated May 27, 2016 for Singapore Application No. 11201504327V.
Office Action dated Jun. 10, 2016 for U.S. Appl. No. 14/188,504.
Office Action dated Mar. 10, 2016 for U.S. Appl. No. 14/620,073.
Notice of Acceptance dated Jun. 10, 2016 for Australian Application No. 2012302251.
Office Action for Chinese Patent Application No. 201380065116.7, dated Jun. 28, 2016, including English language summary, 12 pages.
Australian First Patent Examination Report for Application No. 2013334155, dated May 23, 2016, 4 pages.
Extended European Search Report for European Application No. 13862331.9-1708 / 2931627 PCT/US2013/074923, dated Jul. 7, 2016.
English translation of Russian Office Action for Application Serial No. 2014101298, dated Jul. 22, 2016, 7 pages.
Office Action dated May 19, 2015 for Chinese Application No. 201280035667.4.
Office Action Chinese Patent Application No. 201280051426.9 dated Jul. 23, 2015.
Office Action dated Aug. 18, 2015 for U.S. Appl. No. 14/106,212.
Certified English translation of JP2003292663.
English Summary of Russian Office Action for Application Serial No. 2014111340, dated Feb. 25, 2016, 8 pages.
United Kingdom Examination Report for Patent Application No. GB1400762.9 dated Feb. 11, 2016.
Office Action dated Feb. 16, 2016 for U.S. Appl. No. 14/108,142.
Extended European Search Report for European Application No. 13849152.7-1303 / 2912142 PCT/US2013/066811, dated Feb. 12, 2016.
English summary of Spanish Office Action for Application Serial No. P201490025, Feb. 9, 2016, 8 pages.
Supplemental European Search Report for European Application No. 12727994.1-1302, dated Feb. 17, 2016.
Inter Partes Review Petition for U.S. Pat. No. 8,883,280 (712 pages) [Reference submitted in three parts].
Borealis webpage dated Jan. 20, 2010 from Internet Archive (6 pages).
Gibson and Ashby, Cellular solids: structure and properties, 2nd ed., Cambridge University Press (1997) (7 pages).
C. Maier and T. Calafut, Polypropylene: the Definitive User\s Guide and Databook, Plastics Design Library, William Andrew Inc. (1998) (19 pages).
Reichelt et al., Cellular Polymers, vol. 22, No. 5 (2003) (14 pages).
Ratzsch et al., Prog. Polym. Sci., 27 (2002), 1195-1282 (88 pages), Sep. 13, 2016.
Encyclopedia of Polymer Science and Technology: Plastics, Resins, Rubbers, and Fibers, vol. 2, John Wiley & Sons, Inc. (1965) (37 pages).
Shau-Tarng Lee, Chul B. Park, and N.S. Ramesh, Polymer Foams: Science and Technology, CRC Press (2007) (51 pages).
Grant & Hackh\s Chemical Dictionary, 5th ed., McGraw-Hill, Inc. (1987) (3 pages).
Merriam-Webster\s Collegiate Dictionary, 11th ed. (2003), p. 70 (3 pages).
Merriam-Webster\s Collegiate Dictionary, 11th ed. (2003), p. 1237 (3 pages).
Hawley\s Condensed Chemical Dictionary, 14th Ed. (2001) (5 pages).
Reichelt et al., Abstract of PP-Blends with Tailored Foamability and Mechanical Properties, Cellular Polymers, (2003) available from http://www.polymerjournals.com/journals.asp?Page=111 &JournalType=cp&JournalIssue=cp22-5&,J1P=, listing (4 pages).
Ratzsch et al., Abstract of Radical Reactions on Polypropylene in the Solid State, Progress in Polymer Science, vol. 27, Issue 7, (Sep. 2002), available from http://www.sciencedirect.com/science/article/pii/S0079670002000060 (3 pages).
"Borealis Dapoly HMS Polypropylene for Foam Extrusion" obtained from Borealis webpage obtained from the Internet Archive\s "Wayback Machine" as of Nov. 16, 2008 (https://web.archive.org/web/20081116085125/http://www.borealisgroup.com/pdf/literature/borealis-borouge/brochure/K_IN0020_GB_FF_2007_10_BB.pdf) ("Brochure \08") (20 pages).
Office Action dated Sep. 1, 2016 for U.S. Appl. No. 14/106,212.
Office Action dated Sep. 27, 2016 for U.S. Appl. No. 14/725,319.
British Examamination Report for GB Application No. GB1400762.9, sent on Aug. 8, 2016, 2 pages.
Extended European Search Report for European Application No. 13863546.1 established Jul. 12, 2016, 7 pages.
Office Action dated Aug. 9, 2016 for U.S. Appl. No. 14/108,142.
Jacoby, Philip, "Recent Insights on the Use of Beta Nucleation to Improve the Thermoforming Characteristics of Polypropylene," Society of Plastics Engineers, Annual Technical Conference Proceedings, ANTEC 2012, Apr. 2012, pp. 2292-2296.

(56) References Cited

OTHER PUBLICATIONS

Singapore Written Opinion for Singapore Patent Application No. 11201504756T established Jul. 19, 2016, 7 pages.
Australian First Patent Examination Report for Application No. 2013359097 sent Aug. 26, 2016, 3 pages.
Office Action dated Oct. 7, 2016 for U.S. Appl. No. 14/739,510.
Japanese Office Action for Japanese Application No. 2014-515882, dispatched Aug. 30, 2016, 6 pages.
Mexican Office Action for Mexican Application MX/a/2013/014993 received on Sep. 27, 2016, 6 pages.
New Zealand Examination Report for New Zealanc Application No. 708463 received Oct. 3, 2016, 3 pages.
Australian Patent Examination Report for Australian App. No. 2013334155 issued on Oct. 24, 2016, 7 pages.
New Zealand First Examination Report for New Zealand Application 708546 received Sep. 26, 2016, 4 pages.
Russian Office Action for Russian Application No. 2014101298 received Sep. 30, 2016, 6 pages.
European Examination Report for European App. No. 12727994.1 received on Sep. 23, 2016, 4 pages.
European Search Report for European App. No. 13849152.7 received Sep. 16, 2016, 3 pages.
Chinese Office Action for Chinese App. No. 201380065127.5 received Jul. 26, 2016, 11 pages.
Zealand Examination Report for New Zealand Application No. 708552 received on Oct. 7, 2016, 4 pages.
Chinese Office Action for Chinese App. No. 201380065089.3 received Sep. 30, 2016, 12 pages.
Taiwan Office Action for Taiwan Pat. App. No. 102146299 received on Oct. 21, 2016, 7 pages.
Office Action dated Nov. 18, 2016 for U.S. Appl. No. 14/718,836.
Third Party Observation filed in European Patent App. No. 12727994.1 received on Nov. 4, 2016, 11 pages.
International Standard ISO 16790:2005(E), 20 pages.
S. Muke et al., The Melt Extensibility of Polypropylene, Polym. Int. 2001,515-523, 9 pages.
P. Spitael and C.W. Macosko, Strain Hardening in Polypropylenes and its Role in Extrusion Foaming, Polym. Eng. Sci. 2004, 2090-2100.
Combined Search and Examination Report for Great Britain App. No. GB1616321.4 received Oct. 12, 2016, 4 pages.
British Examination Report for GB App. No. 1400762.9 received Oct. 12, 2016, 2 pages.
Chinese Office Action for Chinese Applicaiton 201380065781.6 received Oct. 18, 2016, 33 pages.
Research Progress of Polypropylene Foamed Material, Baiquan Chen et al., Plastics Manufacture, No. 12, pp. 55-58.
Modification and Formulation of Polypropylene, Mingshan Yang edits, Chemical Industry Press, p. 43, the second paragraph from the bottom, Jan. 31, 2009.
Extended European Search Report for European App. No. 13863649.3 received Sep. 27, 2016, 9 pages.
Office Action dated Nov. 4, 2016 for U.S. Appl. No. 13/961,411.
Chinese Office Action for Chinese Application No. 201280051426.9 received Nov. 1, 2016, 9 pages.
English Summary of Chinese Office Action for Application Serial No. 201380041896.1, dated Nov. 11, 2016, 11 pages.
Extended European Search Report for European App. No. 14775300.8 sent Oct. 24, 2016, 9 pages.

* cited by examiner

BRIM OF AN INSULATED CONTAINER

PRIORITY CLAIM

This application claims priority under 35 U.S.C. §119(e) to U.S. Provisional Application Ser. No. 61/737,255, filed Dec. 14, 2012, which is expressly incorporated by reference herein.

BACKGROUND

The present disclosure relates to vessels, and in particular to insulated containers, such as cups, for containing hot or cold beverages or food. More particularly, the present disclosure relates to an insulated cup formed from polymeric materials.

SUMMARY

A vessel in accordance with the present disclosure is configured to hold a product in an interior region formed in the vessel. In illustrative embodiments, the vessel is an insulated container such as a drink cup, a food-storage cup, or a dessert cup.

In illustrative embodiments, an insulative cup includes a floor and a sleeve-shaped side wall coupled to the floor to define an interior region suitable for storing food, liquid, or any suitable product. The insulative cup also includes a rolled brim coupled to an upper end of the side wall. The rolled brim is made of a polymeric material and is formed using a brim-rolling process. The rolled brim is formed to include opposite end portions that overlap and mate to establish a brim seam.

In illustrative embodiments, the rolled brim also includes a curved brim lip having a first end and an opposite second end arranged to lie in spaced-apart relation to the first end. The brim seam is curved and arranged to interconnect the opposed ends of the curved brim lip. The side wall includes vertical end strips and a funnel-shaped web that is arranged to interconnect the vertical end strips. The vertical end strips overlap and mate to form a side-wall seam that is aligned in registry with the brim seam in the overlying rolled brim.

In illustrative embodiments, the rolled brim is configured in accordance with the present disclosure to have a rolled-brim efficiency in a range of about 1.0 to about 1.2 to cause a substantially endless and even (i.e., substantially uninterrupted) outer surface of the rolled brim at the brim seam to be established without any substantial elevation step between a first end of the brim lip and the brim seam at a junction between the brim lip and the brim seam so that fluid leak paths between a brim-engaging lid and the rolled brim at the brim seam are minimized when the lid is coupled to the rolled brim. In illustrative embodiments, the rolled brim and the rest of the insulative cup is made of a plastics material such as an insulative cellular non-aromatic polymeric material.

In illustrative embodiments, the insulative cup passes a leak performance test. In illustrative embodiments, the leak performance test is performed according to the Montreal leak test procedure.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

Figure 1B:
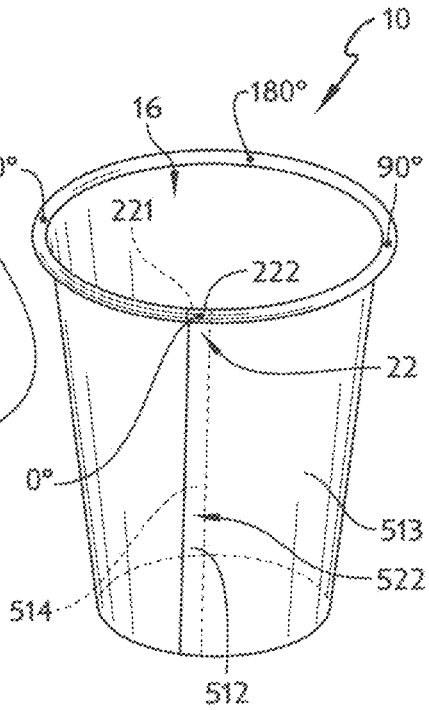
Figure 1A:
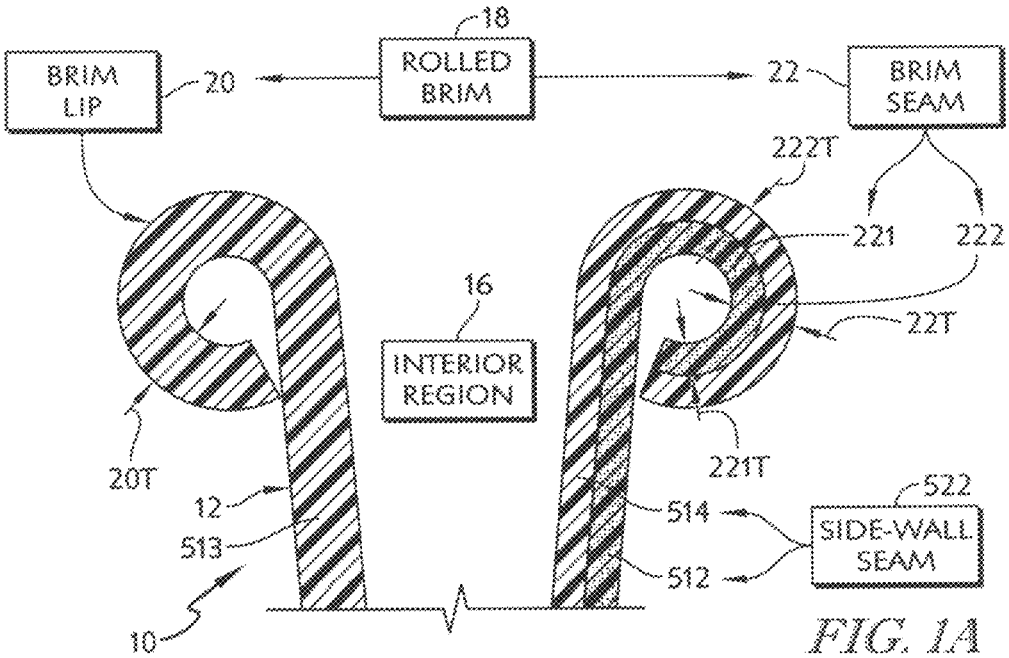
Figure 2:
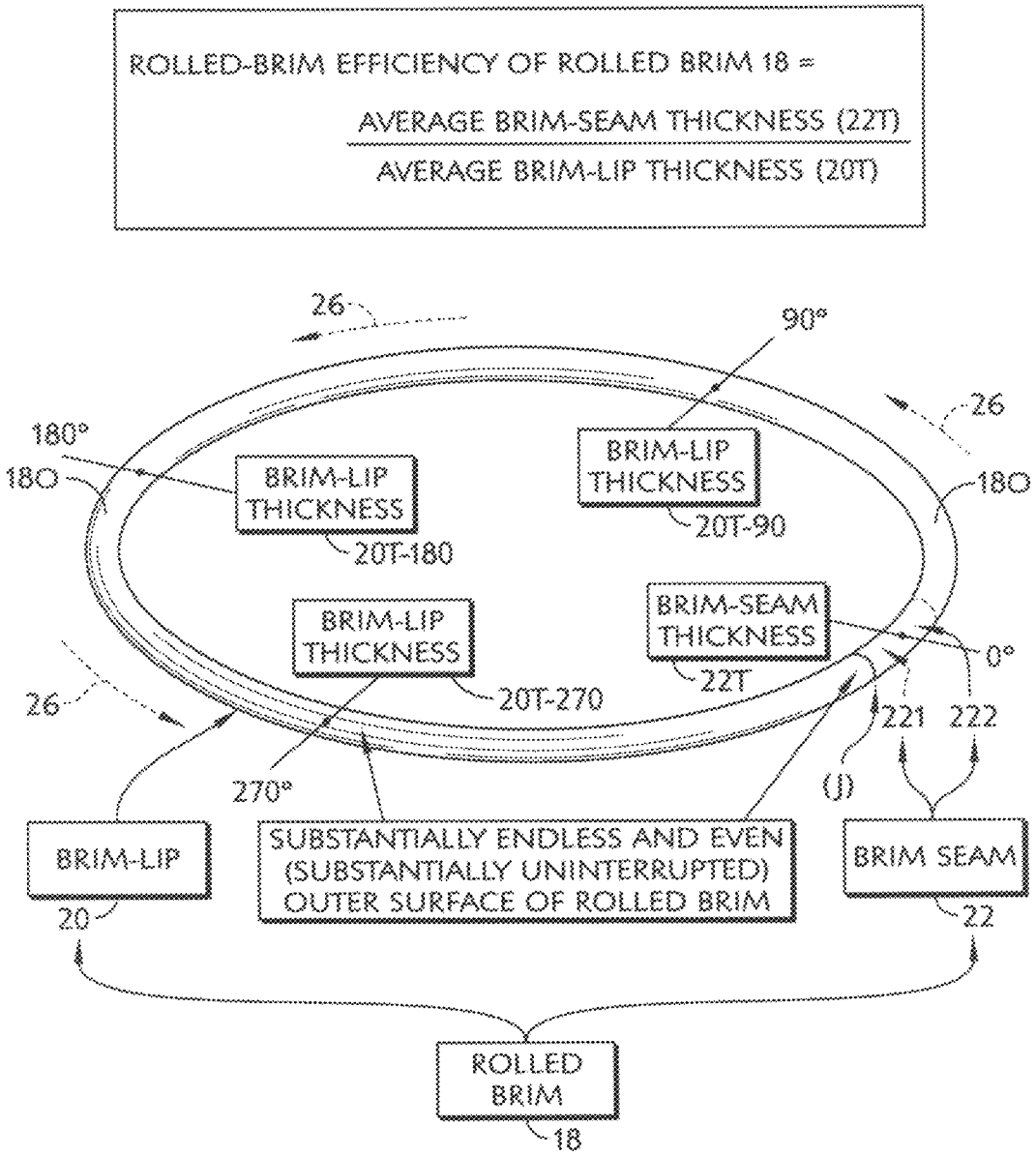
Figure 3:
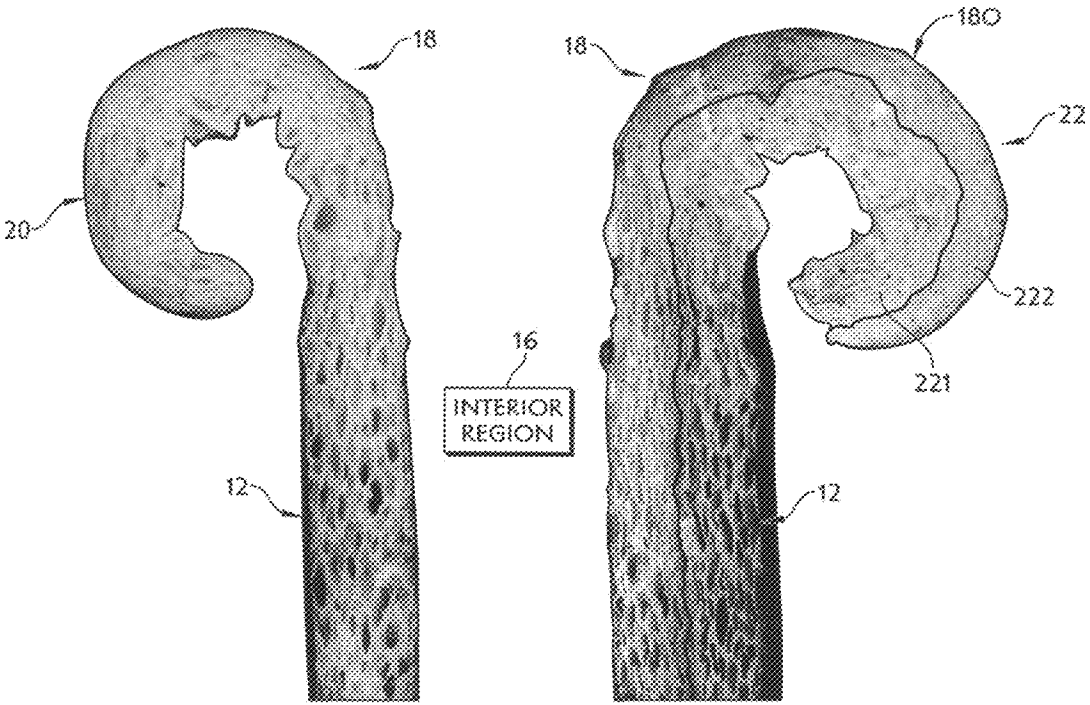
Figure 4:
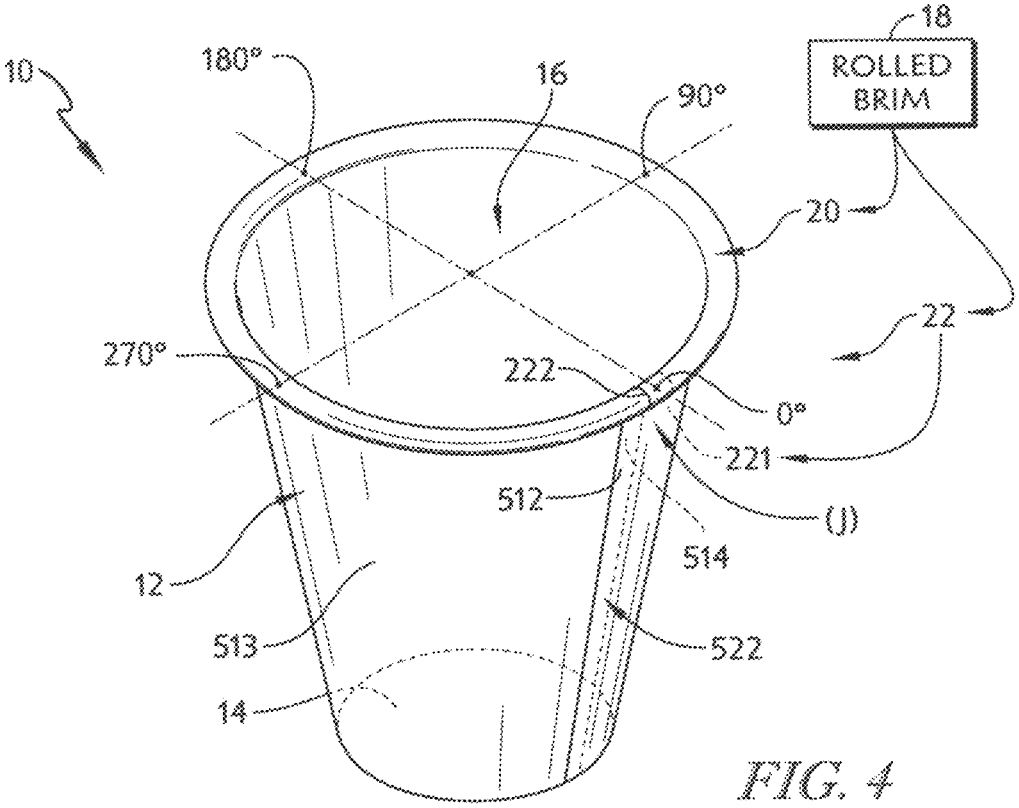
Figure 5:
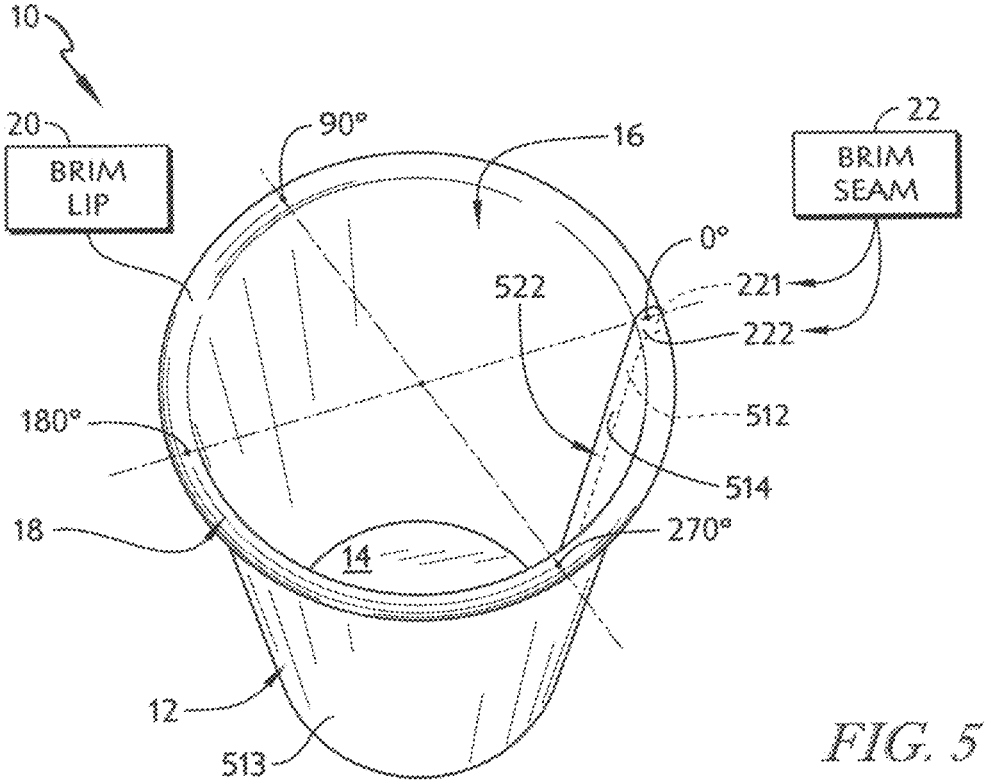
Figure 6:
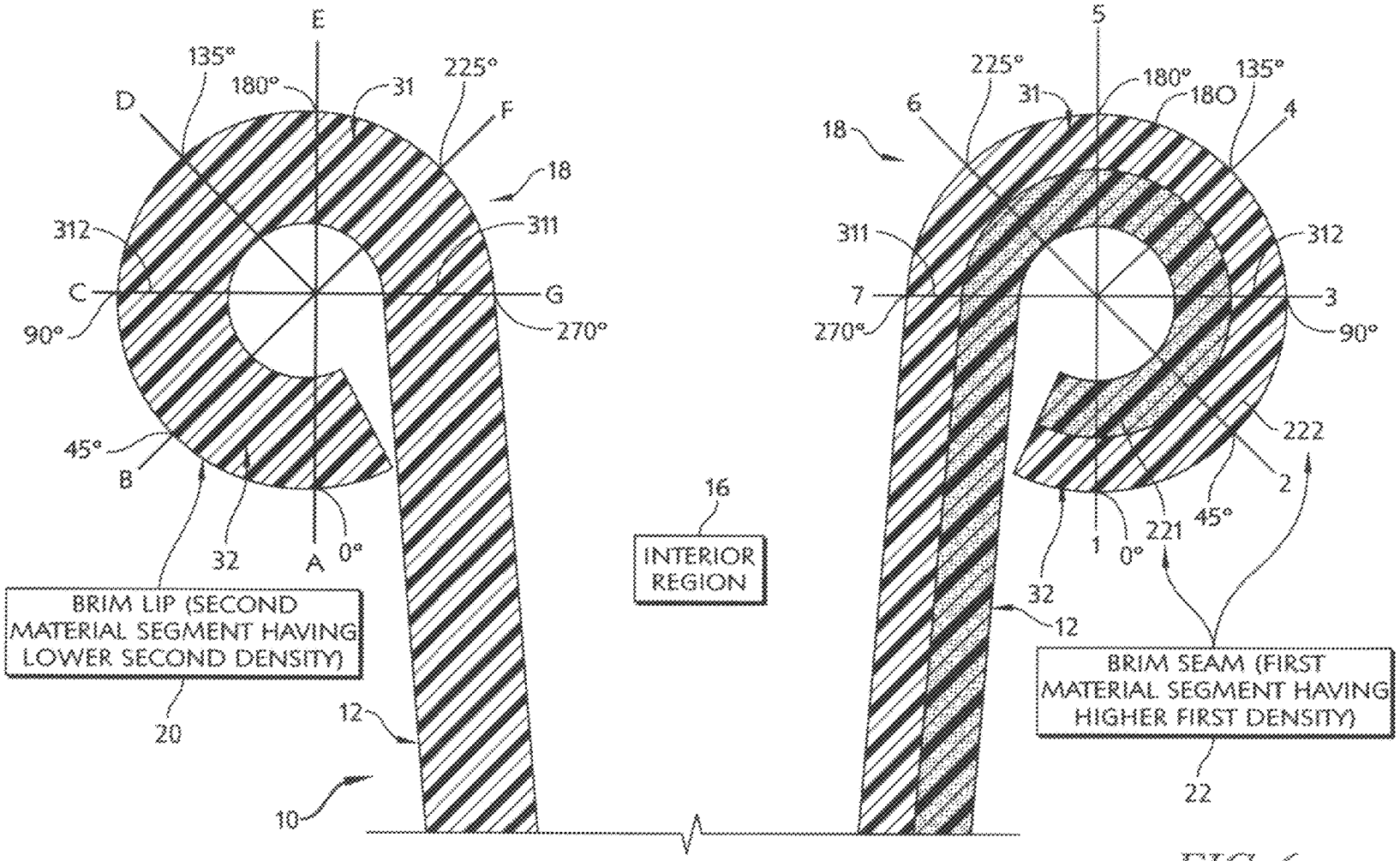
Figure 7:
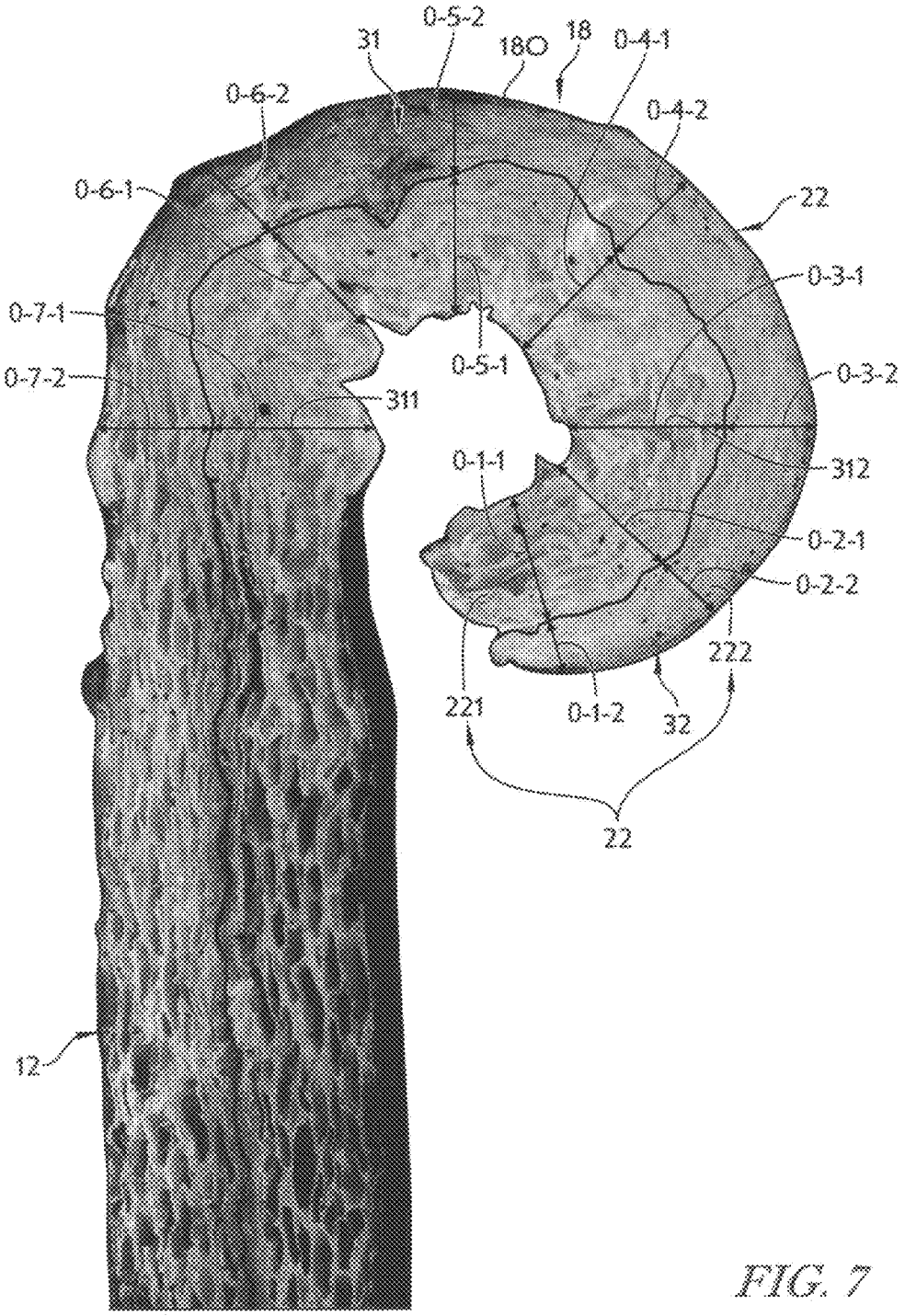
Figure 8:
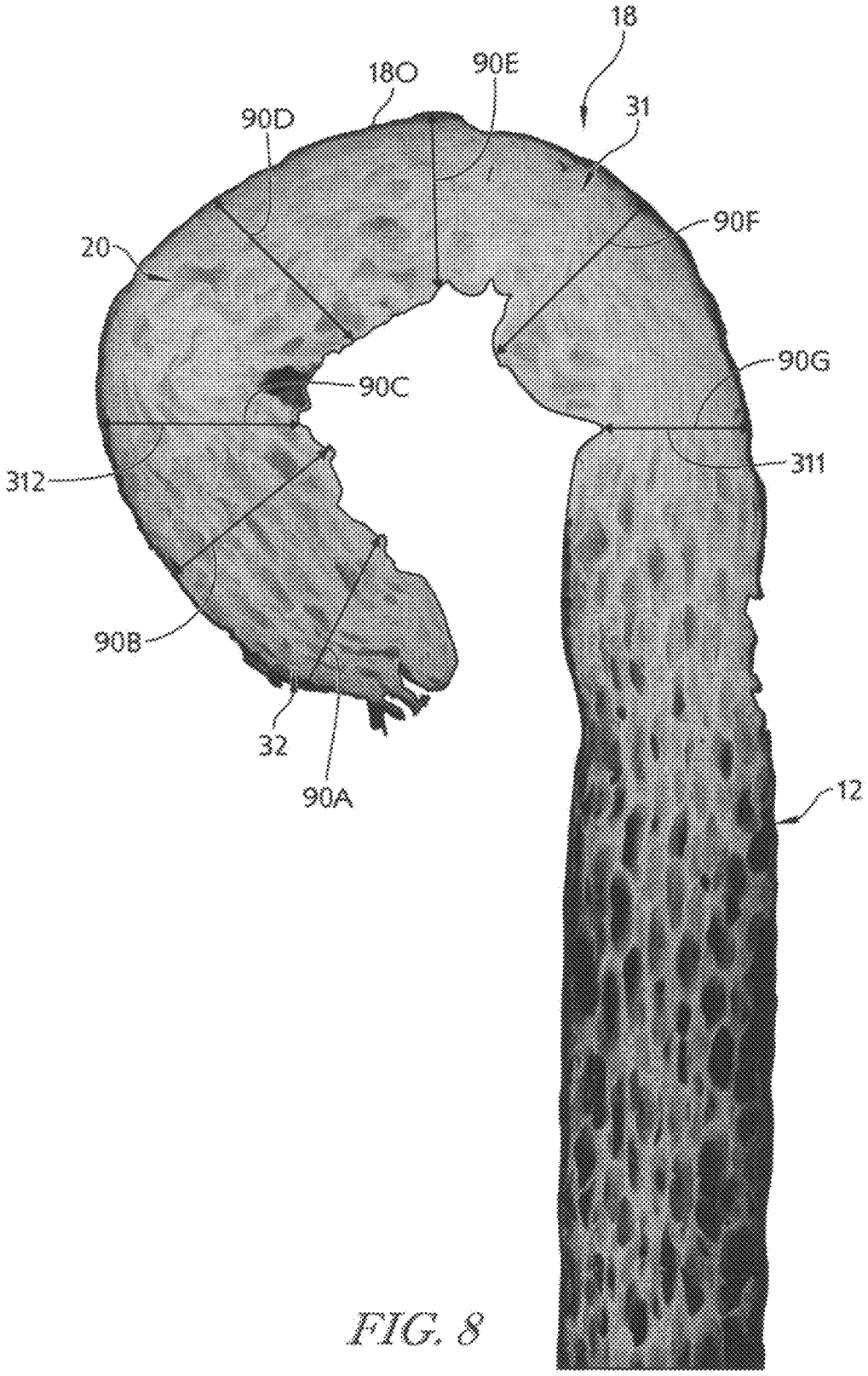
Figure 9:
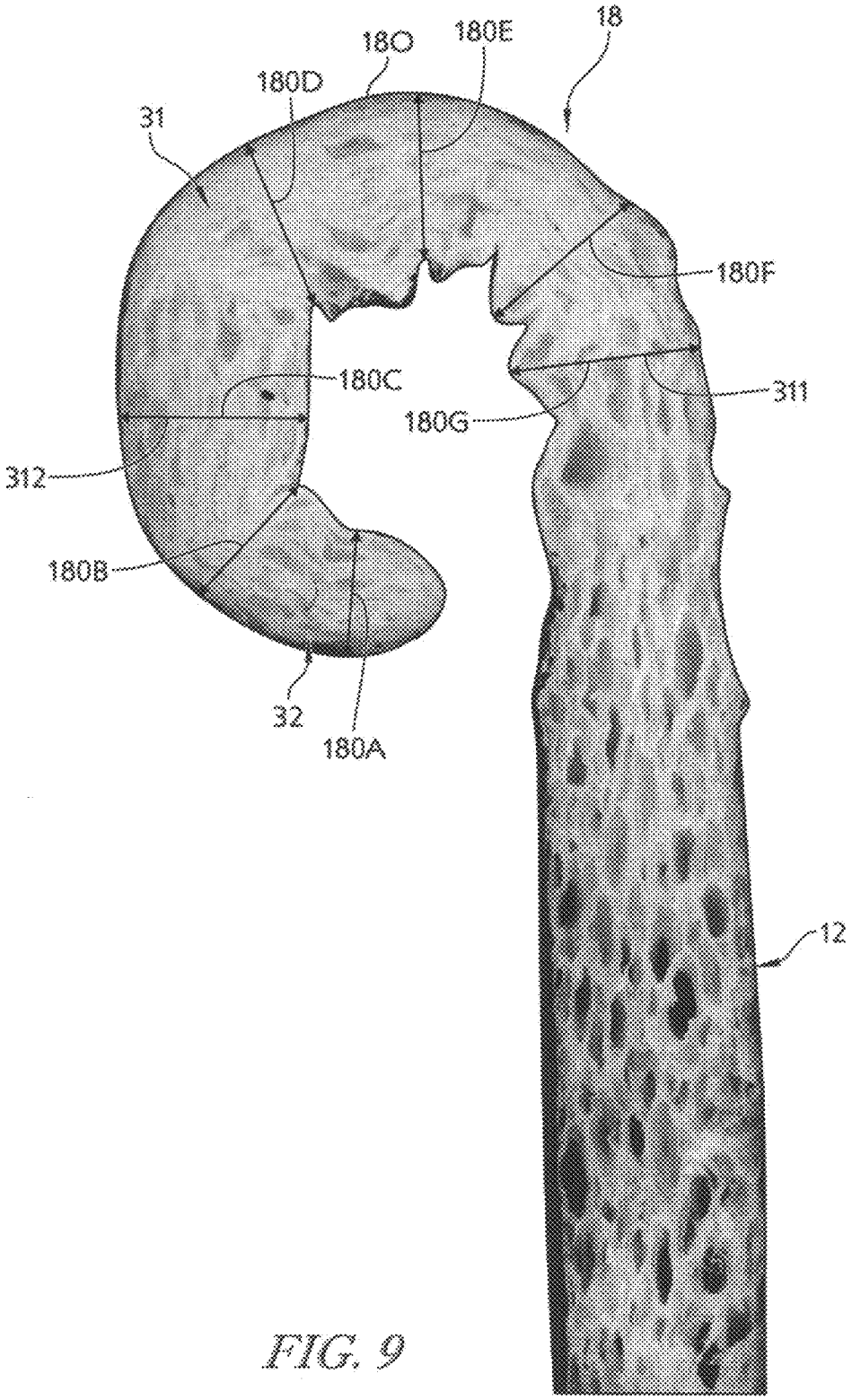
Figure 10:
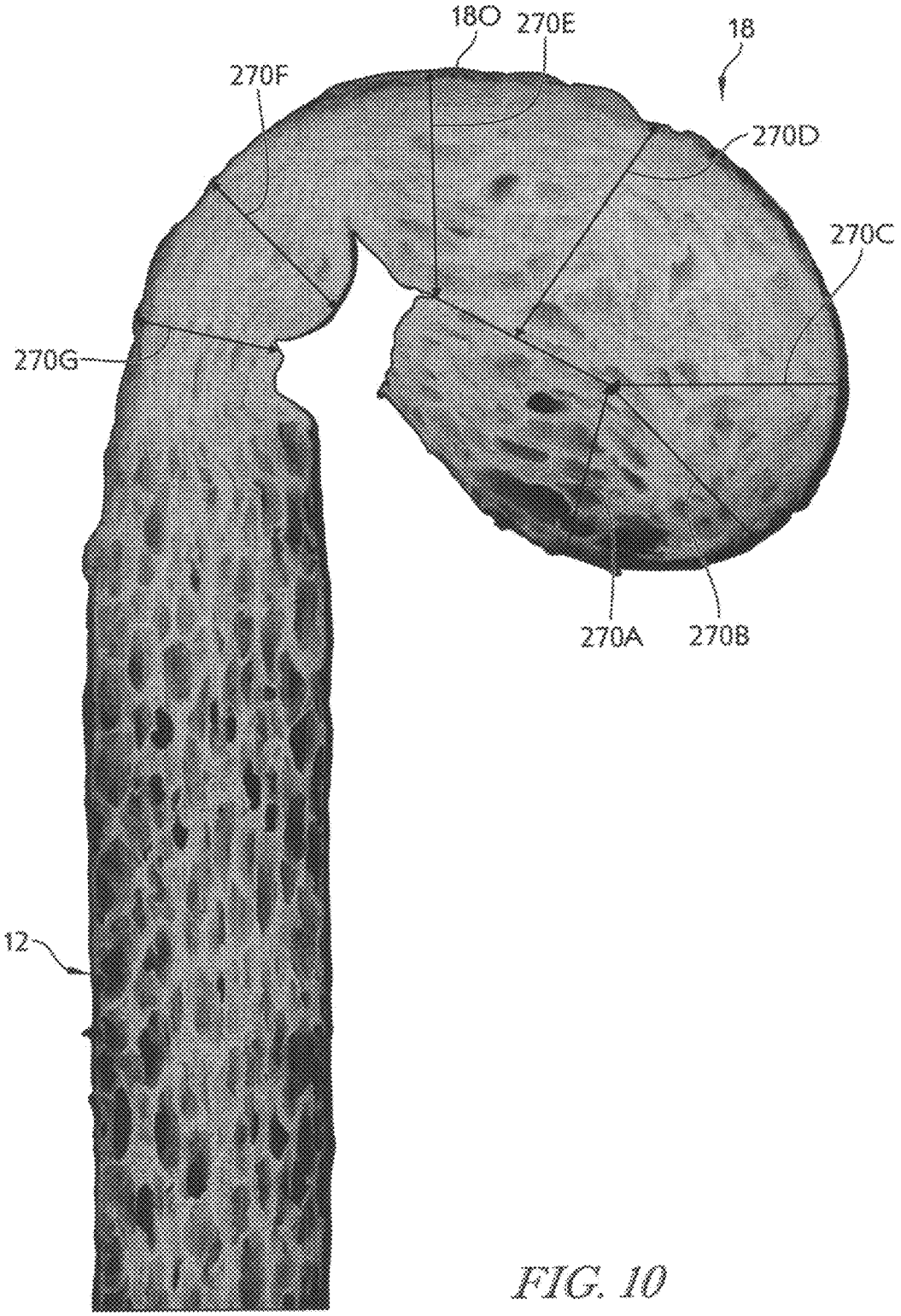
Figure 11:
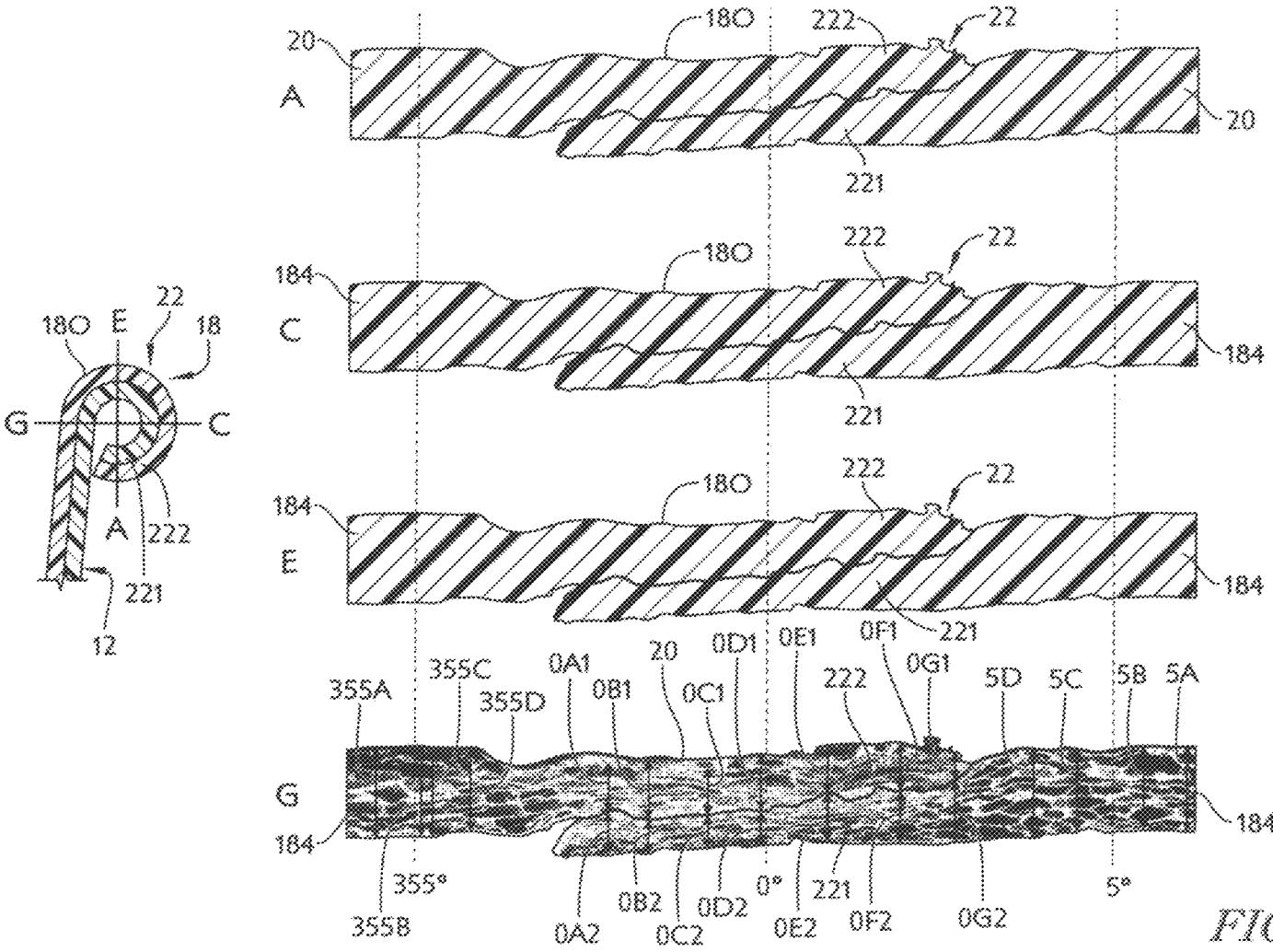
Figure 12:
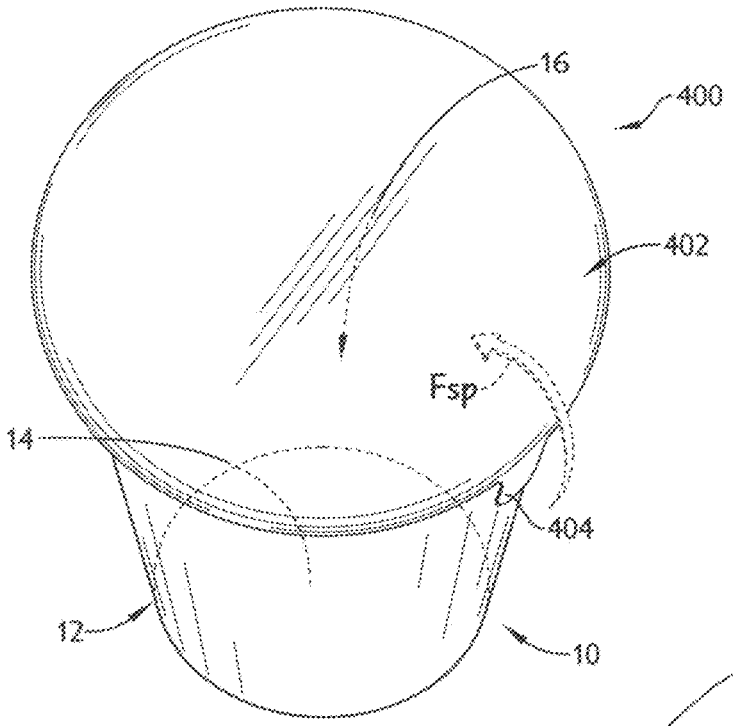
Figure 13:
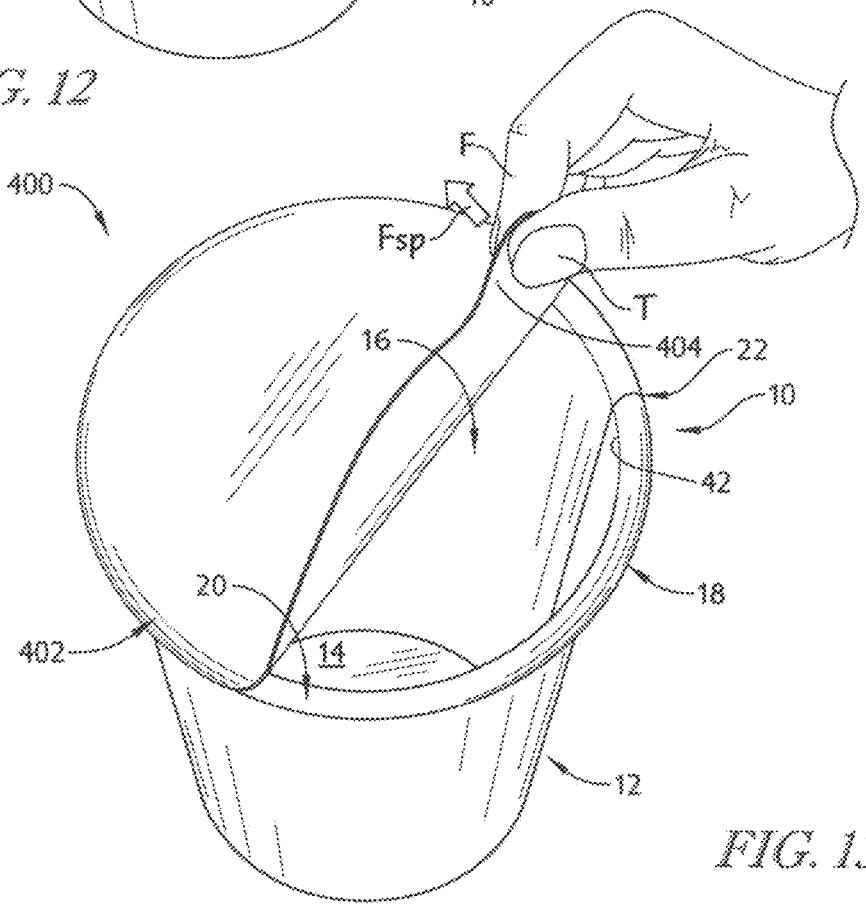

The detailed description particularly refers to the accompanying figures in which:

FIG. 1 is a perspective view of an insulative cup in accordance with the present disclosure showing that the insulative cup includes, from top to bottom, a rolled brim, a sleeve-shaped side wall, and a floor wherein portions of the insulative cup are broken away to show (1) a brim seam (at a 0° compass bearing point on the compass-shaped rolled brim) including an exposed somewhat tubular inner rolled tab and a somewhat tubular outer rolled tab that is wrapped around the inner rolled tab in a manner shown in more detail on the right side of FIG. 1A and (2) a brim lip (at a 180° compass bearing point on the compass-shaped rolled brim) shown in more detail on the left side of FIG. 1A;

FIG. 1A is a partial diagrammatic and dead section view of the rolled brim and sleeve-shaped side wall of FIG. 1 taken generally along line 1A-1A of FIG. 1 showing that the rolled brim is made of a single plastics material and includes a one-piece brim lip as shown on the left side of the page and a two-piece brim seam comprising an inner rolled tab and an outer rolled tab arranged to overlie and mate with the inner rolled tab as shown on the right side of the page and showing that the side wall includes a two-piece side-wall seam arranged to extend downwardly from the two-piece brim seam;

FIG. 1B is a perspective view of the insulative cup of FIG. 1 (after the cup has been rotated one-quarter turn (90°) about a central vertical axis in a clockwise direction) showing that the arcuate brim seam at the 0° compass bearing point has an arc length that subtends an angle less than 10° and that the brim lip that makes up the rest of the rolled brim is C-shaped and has an arc length that subtends an angle of about 350° and showing that the rolled brim has an area of localized plastic deformation at about the 0° compass bearing point which provides for a substantially endless and even (i.e., substantially uninterrupted) outer surface on the rolled brim at the brim seam;

FIG. 2 is a diagrammatic view of the rolled brim illustrated in FIGS. 1, 1A, and 1B suggesting that at junction point (J) on the rolling brim where the brim lip meets the brim seam is substantially uninterrupted owing to the substantially endless and even outer surface of the rolling brim established by localized plastic deformation of the brim seam in accordance with the present disclosure and suggesting that a rolled-brim efficiency of the rolled brim as calculated in accordance with the present disclosure is equivalent to an average brim-seam thickness taken at a selected angular location along the brim seam at a 0° compass bearing point on the brim seam of the rolled brim divided by an average brim-lip thickness taken at a companion selected angular location along the brim lip at selected compass bearing points on the brim lip of the rolled brim;

FIG. 3 is similar to FIG. 1A and is a partial diagrammatic and photographic view of a rolled brim and sleeve-shaped side wall included in an insulative cup made in accordance with the present disclosure showing that a brim lip included in the rolled brim has a generally constant brim-lip thickness throughout and showing that the brim seam included in the rolled brim has an inner rolled tab having a generally constant inner-tab thickness that is smaller than the brim-lip thickness of the brim lip and an outer rolled tab having a generally constant outer-tab thickness that is smaller than the inner-tab thickness of the inner rolled tab;

FIG. 4 is a perspective view of the insulative cup of FIG. 1 showing that the outer surface of the rolled brim is substantially endless and even (i.e., substantially uninterrupted without any substantial elevation change or step) along the entire circumference of the rolled brim and particularly at a junction (J) between the brim lip and the brim seam at about the 0° compass bearing point on the rolled brim;

FIG. 5 is a perspective view of the insulative cup of FIG. 4 showing that the sleeve-shaped side wall includes an upright inner strip (shown in solid), an upright outer strip (shown in phantom) that is arranged to overlie and mate with the upright inner strip to establish a side-wall seam, and a funnel-shaped web interconnecting the upright inner and outer strips, and showing that the side-wall seam is aligned in registry with the overlying brim seam;

FIG. 6 is a view similar to FIG. 2 showing a coordinate system for measuring brim-lip thicknesses of the brim lip (on the left) and brim-seam thicknesses of the brim seam (on the right) at different radial thickness-measurement locations along each of the brim lip and the brim seam for use in a calculation of a rolled-brim efficiency of the rolled brim in accordance with the present disclosure;

FIG. 7 is an enlarged color photograph of the brim seam shown in FIG. 3 showing that seven brim-seam thickness measurements have been taken along each of the inner and outer rolled tabs of the brim seam at seven equally spaced-apart angular thickness-measurement locations beginning at about a six o'clock position and ending at about a nine o'clock position for use in determining an average brim-seam thickness of the brim seam at the 0° compass bearing point on the rolled brim to enable calculation of the rolled-brim efficiency of the rolled brim;

FIG. 8 is an enlarged color photograph of a first section of the brim lip of FIG. 3 taken at a 90° compass bearing point on the rolled brim as suggested in FIGS. 1 and 2 and showing that seven brim-lip thickness measurements have been taken at seven equally spaced-apart angular thickness-measurement locations beginning at about a six o'clock position and ending at about a three o'clock position for use in determining an average brim-lip thickness of the brim lip at the 90° compass bearing point on the rolled brim to enable calculation of the rolled-brim efficiency;

FIG. 9 is an enlarged color photograph of a second section of the brim lip taken at a 180° compass bearing point on the rolled brim as suggested in FIGS. 1 and 2 and showing that seven brim-lip thickness measurements have been taken at seven equally spaced-apart angular thickness-measurement locations along the brim lip for use in determining an average brim-lip thickness of the brim lip at the 180° compass bearing point on the rolled brim to enable calculation of the rolled-brim efficiency;

FIG. 10 is a color photograph of a third section of the brim lip taken at a 270° compass bearing point on the rolled brim as suggested in FIG. 1 and showing that seven brim-lip thickness measurements have been taken at seven equally spaced-apart angular thickness-measurement locations along the brim lip for use in determining an average brim-lip thickness of the brim lip at the 270° compass bearing point on the rolled brim to enable calculation of the rolled-brim efficiency;

FIG. 11 is a diagrammatic view showing how the thickness of the rolled brim changes just before the brim seam, at the brim seam, and just after the brim seam at the 0° compass bearing point on the rolled brim as suggested in FIGS. 1, 4, and 5;

FIG. 12 is a perspective view of a package in accordance with the present disclosure showing that the package includes the insulative cup of FIG. 1 and a closure formed from a peelable film that is coupled to the rolled brim of the insulative cup to close a mouth formed in the insulative cup to open into an interior region of the insulative cup; and FIG. 13 is a view similar to FIG. 12 showing a user grasping a pull tab included in the peelable film and applying a sideways peeling force to the pull tab and peelable film to cause the peelable film to separate from the rolled brim of the container to provide access to the interior region of the insulative cup through the open mouth.

DETAILED DESCRIPTION

An insulative cup 10 in accordance with the present disclosure includes a sleeve-shaped side wall 12, a floor 14 coupled to sleeve-shaped side wall 12 to define an interior region 16 therebetween, and a rolled brim 18 coupled to an upper portion of sleeve-shaped side wall 12 as shown in FIGS. 1, 4, and 5. As suggested diagrammatically in FIG. 2, rolled brim 18 includes an outer surface 18O that has a substantially endless and even (substantially uninterrupted) shape about its circumference and at a junction (J) provided between a brim lip 20 and a companion brim seam 22. There is no apparent step or elevation change at junction (J) between adjacent portions of the outer surface 18O of brim lip 20 and brim seam 22 as suggested in FIGS. 1B, 2, 4, and 5.

Insulative cup 10 is made from, for example, an insulative cellular non-aromatic polymeric material that allows for localized plastic deformation so that desirable features may be provided in insulative cup 10. A material has been plastically deformed, for example, when it has changed shape to take on a permanent set in response to exposure to an external compression load and remains in that new shape after the load has been removed. Rolled brim 18 has undergone localized plastic deformation at a brim seam 22 to provide a substantially endless and even (i.e., substantially uninterrupted) outer surface 18O of the rolled brim 18 so that fluid leak paths that might otherwise be formed when a lid is coupled to the rolled brim 18 are minimized.

Sleeve-shaped side wall 12, floor 14, and rolled brim 18 of cup 10 are formed from a strip of insulative cellular non-aromatic polymeric material as disclosed herein. In accordance with the present disclosure, a strip of insulative cellular non-aromatic polymeric material is configured (by application of pressure—with or without application of heat) to provide means for enabling localized plastic deformation in the rolled brim 18 at the brim seam 22 to provide a plastically deformed first material segment (e.g., brim seam 22) having a first density located in a first portion of the rolled brim and a second material segment (e.g., brim lip 20) having a second density lower than the first density located in an adjacent second portion of the rolled brim 18 without fracturing the insulative cellular non-aromatic polymeric material so that a predetermined insulative characteristic is maintained and outer surface 18O of rolled brim 18 is substantially endless and even (i.e., uninterrupted) so that fluid leak paths at brim seam 22 are minimized when a lid is coupled to rolled brim 18 of insulative cup 10.

Rolled brim 18 is coupled to an upper end of side wall 12 to lie in spaced-apart relation to floor 14 to frame an opening into interior region 16 as shown, for example, in FIGS. 1-5. Rolled brim 18 includes a C-shaped brim lip 20 and a brim seam 22. Brim seam 22 comprises an inner rolled tab 221 and an outer rolled tab 222 as suggested in FIGS. 1-3. C-shaped brim lip 20 is arranged to extend between and interconnect opposite ends of inner rolled tab 221 and outer rolled tab 222 of brim seam 22 as shown in FIGS. 1, 2, 4, and 5. Brim lip 20 is configured to have a brim-lip thickness 20T as shown in FIG. 1A. Inner rolled tab 221 of brim seam 22 is configured to have an inner-tab thickness 221T and outer rolled tab 222 of brim seam 22 is configured to have an outer-tab thickness 222T as shown in FIG. 1A. In comparison, brim-lip thickness 20T is about equal to the sum of inner-tab thickness 221T and outer-tab thickness 222T.

During cup forming, outer rolled tab 222 is arranged to overlie and couple to an outwardly facing surface of inner rolled tab 221 to establish a brim seam 22 as shown in FIGS. 1 and 1A. In one illustrative example, brim seam 22 is arranged to lie at a compass bearing point of about zero degrees on rolled brim 18 and brim lip 20 extends from a point just past zero degrees to 90 degrees, through 180 degrees, through 270 degrees and back to nearly zero degrees as shown in FIGS. 1, 2, 4, and 5.

In one illustrative example, inner rolled tab 221 and outer rolled tab 222 cooperate and mate to form a brim seam 22 that is configured to provide the first material segment having a higher first density. Brim lip 20 interconnecting opposite ends of inner rolled tab 221 and outer rolled tab 222 is configured to provide the second material segment having a relatively lower second density. As a result, a rolled-brim efficiency of rolled brim 18 in accordance with the present disclosure and suggested in FIG. 2 is established.

Sleeve-shaped side wall 12 of cup 10 includes an upright outer strip 512 at one end, an upright inner strip 514 at an opposite end, and a funnel-shaped web 513 interconnecting the outer and inner strips 512, 514 as shown, for example, in FIGS. 1B, 4, and 5. It is within the scope of this disclosure to provide web 513 with any suitable shape. Upright outer strip 512 is arranged to overlie and mate with upright inner strip 514 to establish a side-wall seam 522 as suggested in FIGS. 1, 1A, and 1B. Side-wall seam 522 is aligned in registry with the overlying brim seam 22 as suggested in FIGS. 1A, 1B, and 4. Outer strip 512 is coupled to inner rolled tab 521 and inner strip 514 is coupled to outer rolled tab 522 as suggested in FIGS. 1A and 6.

A brim-rolled efficiency of about 1.0 indicates that brim seam 22 has a brim-seam thickness 22T which is about equal to brim-lip thickness 20T of brim lip 20 as shown in FIG. 3A. In one illustrative example, the insulative cellular non-aromatic polymeric material is capable of providing a rolled-brim efficiency in a range of about 0.8 to about 1.40. In another illustrative example, the insulative cellular non-aromatic polymeric material is capable of providing a rolled-brim efficiency in a range of about 0.9 to of about 1.3. In still yet another illustrative example, the insulative cellular non-aromatic polymeric material is capable of providing a rolled-brim efficiency of about 0.9 to about 1.2. In still yet another illustrative example, the insulative cellular non-aromatic polymeric material is capable of providing a rolled-brim efficiency in a range of about 1.0 to about 1.2. In a further illustrative example, the insulative cellular non-aromatic polymeric material is capable of providing a rolled-brim efficiency of about 1.02. In a further illustrative example, the insulative cellular non-aromatic polymeric material is capable of providing a rolled-brim efficiency of about 1.11. In a further illustrative example, the insulative cellular non-aromatic polymeric material is capable of providing a rolled-brim efficiency of about 1.16.

The rolled-brim efficiency of rolled brim 18 may be calculated as follows in accordance with the present disclosure. First, rolled brim 18 is cut at zero degrees, 90 degrees, 180 degrees, and 270 degrees along a circumference of rolled brim 18 to provide a profile associated with each compass bearing point location. As shown in FIG. 1, zero degrees is associated with a middle of brim seam 22 and the associated profile is shown in detail in FIG. 7. The profile at 90 degrees is obtained by moving along rolled brim 18 in a counter-clockwise direction 26 as suggested in FIG. 2. Next, thicknesses at various angular thickness-measurement locations along each profile are measured as suggested in FIGS. 7-10. The thicknesses at each angular thickness-measurement location for profiles associated with 90 degrees, 180 degrees, and 270 degrees are averaged to determine an average thickness for each location along brim lip 20. The average thickness of brim seam 22 is then divided by the average thickness at each location of brim lip 20 to determine a rolled-brim efficiency at each location. Finally, all the rolled-brim efficiencies are averaged to determine a rolled-brim efficiency for rolled brim 18.

An insulative cup 10 in accordance with the present disclosure was measured according to the process described herein and a rolled-brim efficiency of 1.16 was determined. The measurements and calculations are described in detail below.

As shown, for example, in FIGS. 4 and 5, insulative cup 10 is divided so as to establish a zero-degree profile associated with brim seam 22, a 90-degree profile associated with brim lip 20, a 180-degree profile associated with brim lip 20, and a 270-degree profile associated with brim lip 20. The zero-degree profile is shown, for example, in FIG. 7. The 90-degree profile is shown, for example, in FIG. 8. The 180-degree profile is shown, for example, in FIG. 9. The 270-degree profile is shown, for example, in FIG. 10.

Each profile is then divided again along the profile so that measurements of thickness at each point may be taken. As shown in FIG. 6, the 90-degree and 180-degree profiles are measured at about seven equally spaced angular thickness-measurement locations starting at about a six o'clock position, moving clockwise around the profile, and ending at a three o'clock position. As shown in FIG. 10, the 270-degree profile is measured at about seven equally spaced angular thickness-measurement locations starting at about a six o'clock position and moving counter-clockwise around the profile and ending at about a nine o'clock position. A letter designation is used to identify each angular thickness-measurement location for a selected profile position associated with brim lip 20 starting with A for a six o'clock position and ending with G for the position appended to side wall 12. The zero-degree profile is measured at about seven equally spaced angular thickness-measurement locations starting at about a six o'clock position, moving clockwise around the profile, and ending at a nine o'clock position. A numerical designation is used to identify each angular thickness-measurement location for a selected profile position starting with 1 for a six o'clock position associated with brim seam 22 and ending with 7 for a nine o'clock position.

The zero-degree profile, 90-degree profile, 180-degree profile, and 270-degree profile were measured according to the procedure described below.

1. Cut strips of material from an insulative cup at about zero degrees to provide a zero-degree profile of brim seam 22; 90 degrees to provide the 90-degree profile of brim lip 20; 180 degrees to provide the 180-degree profile of brim lip 20; and 270 degrees to provide the 270-degree profile.
2. Clamp the profile with a flat clamp.
3. Focus a KEYENCE® VHX-1000 Digital Microscope set at 100× on a portion of the profile and adjust lighting onto the profile.
4. Perform image stitching with digital microscope software to create a complete collage image that covers the rolled brim 18 and an upper portion of the side wall 12.
5. Perform measurements for each angular thickness-measurement location 1-7 for both the inner rolled tab 221 and the outer rolled tab 222 on the zero-degree profile of brim seam 22.
6. Perform measurements for each angular thickness-measurement location A-G for each 90-degree profile, 180-degree profile, and 270-degree profile of brim lip 22.
7. Record measurements for all locations on all profiles.

For the zero-degree profile, two measurements were taken at each angular thickness-measurement location 1-7 on brim seam 22 with one measurement for inner rolled tab 221 and another measurement for outer rolled tab 222 as shown in FIG. 7. As a result, a total thickness was determined for each location 1-7 of the zero-degree profile. Table 1 below outlines each measurement taken at the zero-degree profile for three different samples (S1, S2, S3). Sample 2 (S2), for example, is a 16 ounce beverage cup while Sample 3 (S3) is a 30 ounce beverage cup.

TABLE 1

| Zero-Degree Profile Measurements | | | | | | | | | | | |
|---|---|---|---|---|---|---|---|---|---|---|---|
| | Inner Rolled Tab 221 | | | | Outer Rolled Tab 222 | | | | Total | | |
| | | Measurement (mil) | | | | Measurement (mil) | | | (mil) | | |
| Location | Thickness | S1 | S2 | S3 | Thickness | S1 | S2 | S3 | S1 | S2 | S3 |
| 1 | 0-1-1 | 45.55 | 33.42 | 42.46 | 0-1-2 | 10.01 | 24.50 | 18.33 | 55.89 | 57.92 | 60.79 |
| 2 | 0-2-1 | 51.51 | 27.74 | 34.00 | 0-2-2 | 14.12 | 26.40 | 17.71 | 65.63 | 54.14 | 51.71 |
| 3 | 0-3-1 | 55.32 | 30.80 | 35.17 | 0-3-2 | 24.9 | 21.06 | 19.12 | 80.22 | 51.86 | 54.29 |
| 4 | 0-4-1 | 37.74 | 39.02 | 38.85 | 0-4-2 | 34.58 | 22.39 | 19.38 | 72.32 | 61.41 | 58.23 |
| 5 | 0-5-1 | 42.28 | 45.26 | 28.65 | 0-5-2 | 25.06 | 27.26 | 22.75 | 67.34 | 72.52 | 51.37 |
| 6 | 0-6-1 | 36.93 | 35.76 | 28.62 | 0-6-2 | 24.12 | 38.76 | 22.97 | 61.05 | 74.52 | 55.05 |
| 7 | 0-7-1 | 33.17 | 38.10 | 32.08 | 0-7-2 | 30.16 | 33.25 | 35.43 | 63.33 | 71.35 | 74.11 |

For the 90-degree profile, one measurement was taken at each angular thickness-measurement location A-G on brim lip 20 as shown in FIG. 8. The recorded measurements are shown below in Table 2.

TABLE 2

| 90-Degree Profile Measurement | | | | |
|---|---|---|---|---|
| | | Measurement (mil) | | |
| Location | Thickness | S1 | S2 | S3 |
| A | 90-A | 52.79 | 60.53 | 48.08 |
| B | 90-B | 60.55 | 60.82 | 48.82 |
| C | 90-C | 62.37 | 58.00 | 52.51 |
| D | 90-D | 59.75 | 55.81 | 50.46 |
| E | 90-E | 54.38 | 64.57 | 56.65 |
| F | 90-F | 63.02 | 67.00 | 60.33 |
| G | 90-G | 56.48 | 66.5 | 57.56 |

For the 180-degree profile, one measurement was taken at each angular thickness-measurement location A-G on brim lip 20 as shown in FIG. 9. The recorded measurements are shown below in Table 3.

TABLE 3

| 180-Degree Profile Measurement | | | | |
|---|---|---|---|---|
| | | Measurement (mil) | | |
| Location | Thickness | S1 | S2 | S3 |
| A | 180-A | 39.04 | 63.31 | 44.94 |
| B | 180-B | 48.25 | 72.77 | 51.30 |
| C | 180-C | 58.08 | 56.97 | 44.88 |
| D | 180-D | 53.74 | 53.72 | 49.38 |

TABLE 3-continued

| 180-Degree Profile Measurement | | | | |
|---|---|---|---|---|
| | | Measurement (mil) | | |
| Location | Thickness | S1 | S2 | S3 |
| E | 180-E | 61.46 | 59.36 | 54.90 |
| F | 180-F | 57.06 | 64.59 | 56.14 |
| G | 180-G | 61.42 | 64.33 | 53.22 |

For the 270-degree profile, one measurement was taken at each angular thickness-measurement location A-G on brim lip 20 as shown in FIG. 10. The recorded measurements are shown below in Table 4.

TABLE 4

| 270-Degree Profile Measurement | | | | |
|---|---|---|---|---|
| | | Measurement (mil) | | |
| Location | Thickness | S1 | S2 | S3 |
| A | 270-A | 53.15 | 60.53 | 44.61 |
| B | 270-B | 57.91 | 60.82 | 56.41 |
| C | 270-C | 60.25 | 58.00 | 45.97 |
| D | 270-D | 67.16 | 55.81 | 51.13 |
| E | 270-E | 59.07 | 64.57 | 52.11 |
| F | 270-F | 49.83 | 67.00 | 60.41 |
| G | 270-G | 57.48 | 66.50 | 57.65 |

The various measurements taken for each angular thickness-measurement location of the 90-degree, 180-degree, and 270-degree profiles were then averaged together. The average measurements for brim lip 20 are shown below in Table 5.

TABLE 5

| Average Measurements of Brim Lip 20 | | | | | | | | | | | | |
|---|---|---|---|---|---|---|---|---|---|---|---|---|
| | 90-Degree (mil) | | | 180-Degree (mil) | | | 270-Degree (mil) | | | Average (mil) | | |
| | S1 | S2 | S3 | S1 | S2 | S3 | S1 | S2 | S3 | S1 | S2 | S3 |
| A | 52.79 | 60.53 | 48.08 | 39.04 | 63.31 | 44.94 | 53.15 | 60.53 | 44.61 | 48.33 | 61.46 | 45.88 |
| B | 60.55 | 60.82 | 48.82 | 48.25 | 72.77 | 51.30 | 57.91 | 60.82 | 56.41 | 55.57 | 64.80 | 52.18 |
| C | 62.37 | 58.00 | 52.51 | 58.08 | 56.97 | 44.88 | 60.25 | 58.00 | 45.97 | 60.23 | 57.66 | 47.79 |
| D | 59.75 | 55.81 | 50.46 | 53.74 | 53.72 | 49.38 | 67.16 | 55.81 | 51.13 | 60.22 | 55.11 | 50.32 |
| E | 54.38 | 64.57 | 56.65 | 61.46 | 59.36 | 54.90 | 59.07 | 64.57 | 52.11 | 59.20 | 62.83 | 54.55 |
| F | 63.02 | 67.00 | 60.33 | 57.06 | 64.59 | 56.14 | 49.83 | 67.00 | 60.41 | 56.64 | 66.20 | 58.96 |
| G | 56.48 | 66.5 | 57.56 | 61.42 | 64.33 | 53.22 | 57.48 | 66.50 | 57.65 | 58.46 | 65.78 | 56.14 |

The total measured thickness for each angular thickness-measurement location of brim seam 22 is then divided by the average measured thickness of brim lip 20 to obtain a rolled-brim efficiency value for each angular thickness-measurement location. The rolled-brim efficiency value for each location is then averaged together to provide the rolled-brim efficiency of rolled brim 18. The calculations are summarized below in Table 6.

TABLE 6

Rolled-Brim Efficiency Calculations

| Brim Lip 20 | | | | Brim Seam 22 | | | | Brim Efficiency | | |
|---|---|---|---|---|---|---|---|---|---|---|
| | Average Measurement (mil) | | | | Measurement (mil) | | | % | | |
| Location | S1 | S2 | S3 | Location | S1 | S2 | S3 | S1 | S2 | S3 |
| A | 48.33 | 61.46 | 45.88 | 1 | 55.89 | 57.92 | 60.79 | 1.157 | 0.94 | 1.33 |
| B | 55.57 | 64.80 | 52.18 | 2 | 65.63 | 54.14 | 51.71 | 1.181 | 0.84 | 0.99 |
| C | 60.23 | 57.66 | 47.79 | 3 | 80.22 | 51.86 | 54.29 | 1.332 | 0.90 | 1.14 |
| D | 60.22 | 55.11 | 50.32 | 4 | 72.32 | 61.41 | 58.23 | 1.201 | 1.11 | 1.16 |
| E | 59.20 | 62.83 | 54.55 | 5 | 67.34 | 72.52 | 51.37 | 1.137 | 1.15 | 0.94 |
| F | 56.64 | 66.20 | 58.96 | 6 | 61.05 | 74.52 | 55.05 | 1.078 | 1.13 | 0.93 |
| G | 58.46 | 65.78 | 56.14 | 7 | 63.33 | 71.35 | 74.11 | 1.083 | 1.08 | 1.32 |
| | | Rolled-Brim Efficiency | | | | | | 1.167 | 1.02 | 1.11 |
| | | Standard Deviation | | | | | | 0.09 | 0.13 | 0.17 |

As shown above in Table 6, rolled brim 18 has a rolled-brim efficiency of about 1.167 for Sample 1 (S1), 1.02 for Sample 2 (S2), and 1.11 for Sample 3 (S3). As the rolled-brim efficiency approaches 1.0, outer surface 18O of rolled brim 18 becomes more even or uninterrupted at brim seam 22 so that there is little if any noticeable or discernable step (e.g., elevation increase or decrease) formed in rolled brim 18 at brim seam 22. As a result of outer surface 18O becoming more even or uninterrupted, fluid leak paths between the lid and rolled brim 18 at brim seam 22 are minimized when the lid is coupled to rolled brim 18. During cup forming, one or more tools included in a cup-forming machine engage rolled brim 18 and levels outer surface 18O.

In another example of a rolled-brim efficiency calculation, a strip of material was cut from just before brim seam 22, through brim seam 22, and just after brim seam 22 at angular brim-thickness location G on the zero-degree profile. In this example, the strip shows material from about 355 degrees, through zero degrees, and ending at about five degrees on rolled brim 18. As shown in FIG. 11, several measurements of a brim-lip thickness 20T were taken just before brim seam 22 and just after brim seam 22. Brim-lip thicknesses 20T are as shown below in Table 7.

TABLE 7

Average Measurements of Brim Lip Before and After Brim Seam

| Brim Lip 355 Degrees | | Brim Lip 5 Degrees | |
|---|---|---|---|
| Thickness | Measurement (mil) | Thickness | Measurement (mil) |
| 355A | 62.03 | 5A | 60.24 |
| 355B | 63.19 | 5B | 58.92 |

TABLE 7-continued

Average Measurements of Brim Lip Before and After Brim Seam

| Brim Lip 355 Degrees | | Brim Lip 5 Degrees | |
|---|---|---|---|
| Thickness | Measurement (mil) | Thickness | Measurement (mil) |
| 355C | 62.67 | 5C | 60.39 |
| 355D | 59.41 | 5D | 63.37 |

TABLE 7-continued

Average Measurements of Brim Lip Before and After Brim Seam

| Brim Lip 355 Degrees | | Brim Lip 5 Degrees | |
|---|---|---|---|
| Thickness | Measurement (mil) | Thickness | Measurement (mil) |
| Average | 61.83 | Average | 60.73 |
| Standard Deviation | 1.68 | Standard Deviation | 1.88 |
| Average Brim Lip Thickness (mil) | | 61.28 | |

Measurements were then taken for both inner rolled tab 221 and outer rolled tab 222 to determine the average thickness of brim seam 22. Those measurements are summarized below in Table 8.

TABLE 8

Average Measurement at Brim Seam

| | Inner Rolled Tab 221 | | Outer Rolled Tab 222 | | |
|---|---|---|---|---|---|
| Location | Thickness | Measurement (mil) | Thickness | Measurement (mil) | Total (mil) |
| 1 | 0A1 | 35.85 | 0A2 | 29.17 | 65.02 |
| 2 | 0B1 | 39.20 | 0B2 | 26.09 | 65.29 |
| 3 | 0C1 | 29.85 | 0C2 | 26.24 | 56.09 |
| 4 | 0D1 | 31.78 | 0D2 | 30.18 | 61.96 |
| 5 | 0E1 | 34.54 | 0E2 | 33.01 | 67.55 |
| 6 | 0F1 | 34.43 | 0F2 | 37.27 | 71.7 |
| 7 | 0G1 | 21.56 | 0G2 | 41.53 | 63.09 |
| | | Average Total Thickness | | | 64.39 |
| | | Standard Deviation | | | 4.85 |

The rolled-brim efficiency for location G was the calculated by dividing the average brim lip thickness by the average total brim-seam thickness. The result is a rolled-brim efficiency of about 1.05 for point G of rolled brim 22 as shown, for example in FIG. 11. Similar rolled-brim efficiencies may be obtained by taking similar measurements for point E, C, and A. As a result, the thickness of rolled brim 22 may be shown to vary little as one moves around the circumference of rolled brim 22 as suggested in FIG. 11.

In another illustrative example, rolled brim 18 is divided into a first section 31 and a second section 32 as shown in FIG. 6. First section 31 is coupled to sleeve-shaped side wall 12 at a proximal end 311 as shown in FIG. 7. First section 31 is arranged to extend around rolled brim 18 and terminate at a distal end 312 which is about 180 degrees or the three o'clock position as shown in FIG. 7. Second section 32 is coupled to distal end 312 of first section 31 and is arranged to extend downwardly toward side wall 12 as shown in FIG. 7. In this example, first section 31 is configured to provide the first material segment having the higher first density. Second section 32 is configured to provide the second material segment having the lower second density. Sleeve-shaped side wall 12 may also be configured to provide the second material segment having the lower second density.

In still yet another illustrative example, brim seam 22 includes inner rolled tab 221 and outer rolled tab 222 as shown in FIGS. 7 and 11. Outer rolled tab 222 is configured to provide the first material segment having the higher first density. Inner rolled tab 221 is configured to provide the second material segment having the lower second density. As discussed above in Table 1, the thickness 222T of outer rolled tab 222 is less than the thickness 221T of inner rolled tab 221 at each location of measurement. Because thickness of material is related linearly to the density of material, thinner material is denser than thicker material.

Insulative cup 10 of the present disclosure satisfies a long-felt need for a vessel that includes many if not all the features of insulative performance, ready for recyclability, high-quality graphics, chemical resistance, puncture resistance, frangibility resistance, stain resistance, microwavability, resistance to leaching undesirable substances into products stored in the interior region of the insulative cup as discussed above, and a substantially endless and even (i.e., substantially uninterrupted) rolled brim that minimizes leak paths between a lid and the rolled brim. Others have failed to provide a vessel that achieves combinations of these features. This failure is a result of the many features being associated with competitive design choices. As an example, others have created vessels that based on design choices are insulated but suffer from poor puncture resistance, lack of microwavability, leech undesirable substances into products stored in the interior region, and have uneven (i.e., non-level or interrupted) brims providing leak paths between the lid and the rolled brim. In comparison, insulative cup 10 overcomes the failures of others by using an insulative cellular non-aromatic polymeric material. Reference is hereby made to U.S. application Ser. No. 13/491,327 filed Jun. 7, 2012 and titled POLYMERIC MATERIAL FOR AN INSULATED CONTAINER for disclosure relating to such insulative cellular non-aromatic polymeric material, which application is hereby incorporated in its entirety herein.

Brim evenness of an insulative cup in accordance with the present disclosure may also be evaluated with regard to performance of the insulative cup in leak testing. As brim evenness increases, fluid leak paths between a lid and the rolled brim at the brim seam decrease. As a result, more even brims in accordance with the present disclosure will perform better in leak testing than brims having irregularities or step increases in the brim seam due to overlapping of inner and outer rolled tabs 221, 222.

In one example, leak performance is measured according to the procedure described below. This procedure may be called the Montreal leak test procedure.

1. Obtain five insulative cups and five lids at random.
2. Allow insulative cups and lids to come to room temperature prior to testing.
3. Fill a first insulative cup with hot water at about 200° F.
4. Arrange lid so that a sip hole included in the lid is aligned with the brim seam.
5. Mount lid to the insulative cup by placing thumbs together in front of the sip hole and applying pressure around a rim included in the lid until the thumbs touch again on an opposite side of the lid.
6. Visually inspect the rim/brim interface all the way round to ensure the lid is in contact with rolled brim.
7. Tilt insulative cup and lid to between about 45 degrees and 75 degrees relative to the horizontal so that liquid covers the area where the lid meets the brim seam.
8. At the same time liquid covers the area where the lid meets the brim, start a timer.
9. Observe the tilted insulative cup and lid for 10 seconds.
10. Record the number of drops that leak from inside the insulative cup. Failure of the insulative cup and lid combination occurs when more than two drops of liquid leak from outside the interior region during the 10 second period.
11. Repeat steps 3-10 on the remaining four insulative cups.

In another example, leak performance may be measured according to the procedure described below. This procedure may be called the lid fit test procedure.

1. Obtain at least five insulative cups and five lids at random.
2. Allow insulative cups and lids to come to room temperature for at least 24 hours prior to testing.
3. Fill first insulative cup with hot water at about 200° F. if performing a hot-water test or with water at room temperature with green food coloring added if performing a cold-water test.
4. Cover any apertures formed in the lid with tape on an inside of the lid.
5. Arrange the lid so that a sip hole included in the lid is aligned with the brim seam.
6. If performing a hot-water test, mount lid to the insulative cup by placing thumbs together in front of the sip hole and applying pressure around a rim of the lid until the thumbs touch again on an opposite side of the lid. If performing a cold-water test, place the insulative cup on a flat surface holding the cup with one hand and palming the cold cup lid with the other hand.
7. Visually inspect the rim/brim interface all the way around to ensure the lid is in contact with brim.
8. Depress any and all indicator buttons formed in the lid.
9. Observe the insulative cup and lid for failure which occurs if the lid does not fit the insulative cup or the insulative cup will not accept the lid.
10. Record any failures from step 9.
11. For any cups that pass step 9, place a large beaker and a funnel in the beaker on a scale (tare out the scale).
12. Using one of the passing insulative cups from step 9, grasp the cup with the thumb and forefinger at a level one-third down from the top brim of the insulative cup. The thumb and forefinger should encircle the insulative cup with the pinky finger placed under the insulative cup to steady the insulative cup. Take care not to excessively squeeze the insulative cup as this may cause premature leakage.

13. Hold arm steady over the beaker and funnel and oscillate the wrist to agitate the cup for 20 seconds.

14. Observe any leakage from the interface between the rolled brim and the lid and report all observed leakage. If any liquid runs down the side wall of the insulative cup, the insulative cup fails. Record the weight of all liquid collected in the beaker in grams. If liquid collects under the rim but does not drip or run, this is acceptable.

15. Continue using the beaker/funnel from step 13 without taring out the scale.

16. Using the same insulative cup, grasp the insulative cup near its base with a cup seam included in the insulative cup facing up. Take care not to excessively squeeze the insulative cup as this may cause premature leakage.

17. Tilt the insulative cup and lid to between about 55 degrees and 75 degrees relative to the horizontal so that liquid covers the area where the lid meets the brim seam and rotate the insulative cup and lid for 20 seconds over the beaker/funnel.

18. Observe any leakage through rim/brim interface. If a hot-water test, liquid lost through the steam vent should be captured and recorded by the beaker/funnel. If water collects under the rim but does not drip or run, this is acceptable.

19. Record the amount of liquid captured in the beaker/funnel for steps 13 and 17.

20. Repeat steps 3-19 on remaining four insulative cups.

Failure of the insulative cup may occur if there is any crushing of the insulative cup and lid due to size differences between the insulative cup and lid. If a hot-water test, any leakage from the rim or seepage through the side or bottom is a failure. Failure of the insulative cup may also occur if water leaks and runs down the side walls of the cup. Failure may also occur if more than 0.1 grams of water is collected in the beaker/funnel.

Insulative cup 10 in accordance with the present disclosure is capable of passing either leak-testing procedure discussed above with an appropriate lid. In the first leak test, about 121 insulative cups were tested and all 121 passed the leak test. In the second leak test, about 121 insulative cups in accordance with the present disclosure were tested and all 121 insulative cups passed the test.

In a variation of the first test, 20 insulative cups were tilted and observed for 24 hours. After the 24 hour period, all 20 insulative cups passed the extended test as two or less drops were observed leaking between the lid and the even rolled brim of the insulative cup.

In yet another variation of the first test, 100 insulative cups were tilted and observed for both ten seconds and 72 hours. All 100 insulative cups passed the ten-second test as two or less drops were observed leaking during the ten second period. Observation continued for up to 72 hours and about seventeen of the 100 cups leaked more than two drops during the 72 hour period.

In comparison, about 281 insulative cups having an un-even brim with a distinct step formed in the rolled brim at the brim seam were tested according to the first test listed above. As an example, two or more drops were observed leaking from about 137 cups during the ten second observation period. As a result, insulative cups having the un-even brim with the distinct step formed in the rolled brim at the brim seam have a pass rate of about 51 percent. In comparison, insulative cups in accordance with the present disclosure having a substantially endless and even (i.e., substantially uninterrupted) rolled brim at the brim seam have a pass rate of about 100 percent using similar test criteria.

A package 400 in accordance with the present disclosure is shown in FIGS. 12 and 13. Package 400 includes a closure and insulative cup 10 including rolled brim 18 as shown in FIGS. 12 and 13. The closure may be used to close an open mouth 42 defined by rolled brim 18 that opens into interior region 16 as shown in FIGS. 1 and 13. In one example, the closure may be a lid such as a drinking-cup lid formed to include an aperture adapted to receive a drinking straw therein. In another example, the closure may be a lid such as another drinking-cup lid formed to include a sip aperture formed therein. In still yet another example, the closure is formed from a peelable film 402 which is coupled to rolled brim 18 by heat sealing.

In the illustrative example shown in FIG. 12, package 400 includes insulative cup 10 and peelable film 402 coupled to substantially endless and even (i.e., substantially uninterrupted) rolled brim 18. During package filling in a factory, products such as a food or beverage are placed in interior region through open mouth 42. Peelable film 402 is then placed over open mouth 42 and tooling engages peelable film 402 and substantially endless and even (i.e., substantially uninterrupted) rolled brim 18 to heat seal peelable film 402 and couple peelable film 402 to substantially endless and even (i.e., substantially uninterrupted) rolled brim 18 to close open mouth 42. Package 400 is then ready for storage or transportation. While heat sealing may be used to couple peelable film 402 to rolled brim 18, adhesive may also be used to interconnect rolled brim 18 and peelable film 402.

A user opens package 400 by grasping a pull tab 404 included in peelable film 402 with a thumb T and forefinger F. The user then applies a sideways pulling force $F_{SP}$ to pull tab 404 causing peelable film to be separated from smooth rolled brim 18 as shown in FIG. 13 to provide access to products in interior region 16.

In one example, peelable film 402 is made from a polypropylene film. In another example, peelable film 402 is a multi-layer film including a print sub-layer including graphics, a barrier sub-layer configured to block oxygen from moving through the closure, and a polypropylene sub-layer configured to mate with smooth rolled brim 18. However, any other suitable alternatives may be used for peelable film 402.

The invention claimed is:

1. A cup comprising a body made of an insulative cellular non-aromatic polymeric material and formed to include an interior region providing a fluid-holding reservoir and a rolled brim made of the insulative cellular non-aromatic polymeric material and formed to include an interior chamber, the rolled brim being coupled to the body to frame an opening into the interior region and to extend around the body to cause the interior chamber of the rolled brim to lie outside of the interior region of the cup, wherein the rolled brim includes a curved brim lip having a first end and an opposite second end arranged to lie in spaced-apart confronting relation to the first end and a curved brim seam arranged to interconnect the first end and the opposite second end of the curved brim lip, wherein the curved brim seam includes an inner rolled tab coupled to the first end of the curved brim lip and an outer rolled tab coupled to the second end of the curved brim lip and arranged to overlie and mate with an outwardly facing surface of the inner rolled tab, wherein the rolled brim has a rolled-brim efficiency in a range of about 1.0 to about 1.40 to provide a substantially endless and even outer surface of the rolled brim along the entire circumference of the rolled brim with little, if any, step formed in the rolled brim at a junction formed between the curved brim seam and the first end of the curved brim lip so that fluid leak paths that might otherwise be formed when a lid is coupled to the rolled brim to close the opening into the interior region are minimized, wherein the insulative cellular non-aromatic polymeric material is made from a formulation comprising a first polypropylene, and wherein the curved brim lip has a generally constant brim-lip thickness throughout, the inner rolled tab of the curved brim seam has a generally constant inner-tab thickness that is smaller than the brim-lip thickness of the brim lip, and the outer rolled tab of the curved brim seam has a generally constant outer tab thickness that is smaller than the inner-tab thickness of the inner rolled tab.

2. The cup of claim 1, wherein the curved brim seam has an area of localized plastic deformation.

3. The cup of claim 1, wherein the body is defined by a sleeve-shaped side wall including an upright inner strip arranged to bound a portion of the interior region of the body and coupled to the outer rolled tab of the curved brim seam and an upright outer strip coupled to the inner rolled tab of the curved brim seam and arranged to lie outside of the interior region of the body and to overlie and mate with the upright inner strip to establish a side-wall seam that is aligned in registry with the overlying curved brim seam.

4. The cup of claim 1, wherein the rolled brim terminates at an annular distal end that is arranged to surround and lie in spaced-apart relation to the body to define therebetween an annular mouth opening to the interior chamber formed in the rolled brim.

5. The cup of claim 1, wherein the brim seam is defined by a plastically deformed first material segment having a first density and the brim lip is defined by a second material segment having a second density lower than the first density.

6. The cup of claim 1, wherein the rolled brim includes a distal portion formed to include a terminal end of the rolled brim and arranged to lie around and alongside an upper portion of the body and a proximal portion arranged to interconnect the body and the distal portion and define a mouth opening into the interior region of the body, the proximal portion is defined by a first material segment having a first density, and the distal portion is defined by a second material segment having a lower second density.

7. The cup of claim 1, wherein the outer rolled tab of the brim seam is defined by a first material segment having a first density and the inner rolled tab of the brim seam is defined by a second material segment having a lower second density.

8. The cup of claim 1, wherein the rolled-brim efficiency is in a range of about 1.0 to about 1.3.

9. The cup of claim 8, wherein the rolled-brim efficiency is in a range of about 1.0 to about 1.2.

10. The cup of claim 9, wherein the cup passes a leak performance test.

11. The cup of claim 10, wherein the leak performance test is performed according to the Montreal leak test procedure.

12. The cup of claim 1, wherein the formulation further comprises a second polypropylene, at least one nucleating agent, and at least one blowing agent.

13. The cup of claim 12, wherein the first polypropylene is a high melt strength polypropylene having a melt strength of at least 36 centinewtons (cN).

14. The cup of claim 13, wherein the first polypropylene is a homopolymer and the second polypropylene is a homopolymer.

15. A cup comprising a body made of a polypropylene-based polymeric material and formed to include an interior region providing a fluid-holding reservoir and a rolled brim made of the polypropylene-based polymeric material and formed to include an interior chamber, the rolled brim being coupled to the body to frame an opening into the interior region and to extend around the body to cause the interior chamber of the rolled brim to lie outside of the interior region of the cup, wherein the rolled brim includes a curved brim lip having a first end and an opposite second end arranged to lie in spaced-apart confronting relation to the first end and a curved brim seam arranged to interconnect the first end and the opposite second end of the curved brim lip, wherein the curved brim seam includes an inner rolled tab coupled to the first end of the curved brim lip and an outer rolled tab coupled to the second end of the curved brim lip and arranged to overlie and mate with an outwardly facing surface of the inner rolled tab, wherein the rolled brim has a rolled-brim efficiency in a range of about 1.0 to about 1.40 to provide a substantially endless and even outer surface of the rolled brim along the entire circumference of the rolled brim with little, if any, step formed in the rolled brim at a junction formed between the curved brim seam and the first end of the curved brim lip so that fluid leak paths that might otherwise be formed when a lid is coupled to the rolled brim to close the opening into the interior region are minimized, and wherein the curved brim lip has a generally constant brim-lip thickness throughout, the inner rolled tab of the curved brim seam has a generally constant inner-tab thickness that is smaller than the brim-lip thickness of the brim lip, and the outer rolled tab of the curved brim seam has a generally constant outer tab thickness that is smaller than the inner-tab thickness of the inner rolled tab.

16. The cup of claim 15, wherein the polypropylene-based polymeric material is an insulative cellular non-aromatic polymeric material.

17. The cup of claim 15, wherein the rolled brim includes a distal portion formed to include a terminal end of the rolled brim and arranged to lie around and alongside an upper portion of the body and a proximal portion arranged to interconnect the body and the distal portion and define a mouth opening into the interior region of the body, the proximal portion is defined by a first material segment having a first density, and the distal portion is defined by a second material segment having a lower second density.

18. The cup of claim 15, wherein the outer rolled tab of the brim seam is defined by a first material segment having a first density and the inner rolled tab of the brim seam is defined by a second material segment having a lower second density.

* * * * *